United States Patent [19]

Mihara

[11] Patent Number: 4,965,182

[45] Date of Patent: Oct. 23, 1990

[54] SILVER HALIDE PHOTOGRAPHIC EMULSION CONTAINING INFRARED SENSITIZING DYES AND SUPERSENSITIZING COMPOUNDS

[75] Inventor: Yuji Mihara, Kanagawa, Japan

[73] Assignee: Fuji Photo Film Co., Ltd., Kanagawa, Japan

[21] Appl. No.: 373,638

[22] Filed: Jun. 29, 1989

Related U.S. Application Data

[63] Continuation of Ser. No. 64,471, Jun. 22, 1987, abandoned.

[30] Foreign Application Priority Data

Jun. 20, 1986 [JP] Japan ..... 61-142813
Jun. 20, 1986 [JP] Japan ..... 61-142814

[51] Int. Cl.[5] ..... G03C 1/28

[52] U.S. Cl. ..... 430/576; 430/584; 430/567; 430/615

[58] Field of Search ..... 430/615, 567, 584, 576

[56] References Cited

U.S. PATENT DOCUMENTS

| | | | |
|---|---|---|---|
| 4,011,083 | 3/1977 | Durning | 430/584 |
| 4,485,169 | 11/1984 | Ishiguro et al. | 430/615 |
| 4,536,473 | 8/1985 | Mihara | 430/584 |
| 4,596,767 | 6/1986 | Mihara et al. | 430/584 |
| 4,727,017 | 2/1988 | Pollet et al. | 430/611 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide photographic emulsion is disclosed. The emulsion comprises a silver halide, at least one infrared sensitizing dye represented by the following general formula (I) or (II), and at least one compound represented by the following general formula (IIIa) or (IIIb):

(I)

(II)

(IIIa)

(IIIb).

8 Claims, No Drawings

SILVER HALIDE PHOTOGRAPHIC EMULSION CONTAINING INFRARED SENSITIZING DYES AND SUPERSENSITIZING COMPOUNDS

This is a continuation of application Ser. No. 07/064,471 filed June 22, 1987, now abandoned.

FIELD OF THE INVENTION

This invention relates to a silver halide photographic emulsion for silver halide photographic light-sensitive materials, the infrared region of which is spectrally sensitized, and more particularly to a silver halide photographic emulsion for silver halide photographic light-sensitive materials, having improved storage stability and sensitivity of the infrared spectral region.

BACKGROUND OF THE INVENTION

As one light exposure method for photographic light-sensitive materials, an image-forming method using scanner system is known in which an original is scanned and a silver halide photographic light-sensitive material is exposed according to the imaging signal to form a negative or positive image corresponding to the image of the original.

Various recording apparatuses use the scanner system image-forming described above and recording light sources in these scanner system recording apparatuses, include a glow lamp, a xenon lamp, a mercury lamp, a tungsten lamp, a light emitting diode, etc. However, these light sources have the practical disadvantage of weak output and short life. In order to overcome these disadvantages, some scanner systems use coherent laser light sources such as Ne-He lasers, argon lasers, He-Cd lasers, etc. However, although systems using laser light sources give high output, they have the disadvantages that the- scale of the apparatus is larger, its cost is higher, modulators must be used for the light sources, and also safelights for light-sensitive materials are restricted since visible light is used in these systems, reducing the convenience of operation of the system.

On the other hand, in such applications semiconductor lasers have the advantages that the laser device is small in scale and low in cost, modulation can be easily performed, the life of semiconductor laser is longer than that of the other lasers, and also since such a laser emits light in the infrared region, a bright safelight can be used if light-sensitive materials sensitive to infrared region are used, which improves the ease of handling and operating convenience of the system. However, light-sensitive materials having a high sensitivity in the infrared region that are excellent in storage stability have not yet been developed, and hence the advantages of the semiconductor laser having excellent performance as described above have not yet been utilized in this field.

Commercially available photographic films sensitized in the infrared region, include, for example, HTEI 35-20, a trade name, made by Eastman Kodak Company. Such photographic films cannot be allowed to stand at room temperature and must be stored or placed in a refrigerator or a cold place. As will be apparent from the fact, conventional light-sensitive materials sensitized in the infrared region are unstable in sensitivity, and require specific conditions for storage.

For photographic light-sensitive materials, a spectral sensitizing production technique, is known for expanding the light-sensitive wavelength region of a silver halide photographic emulsion to a longer wavelength by adding thereto a certain cyanine dye. Such spectral sensitizing techniques can be applied in not only the visible region but also the infrared region.

For spectral sensitization in the infrared region, sensitizing dyes having an absorption for infrared light are used and examples of these dyes are described, for example, L in Mees, *The Theory of the Photographic Process*, pages 198-201 (Macmillan Co., 3rd ed., 1966). In this case, it is desired that the spectral sensitivity, i.e., the sensitivity for light in an infrared region be high and that the change of the sensitivity be as small as possible during the storage of the silver halide emulsions. For these purposes, various sensitizing dyes have been developed, including, for example, those disclosed in U.S. Pat. Nos. 2,095,854, 2,095,856, 2,955,939, 3,482,978, 3,552,974, 3,573,921, and 3,582,344. However, even when these conventional sensitizing dyes are used, satisfactory sensitivity in infrared regions and storage stability are not obtained.

On the other hand, it is known that the spectral sensitivity of light-sensitive materials is greatly increased by the addition of certain specifically selected organic compounds in combination with these spectral sensitizing dye(s), which provide a super color sensitizing effect. In general, the addition of a second organic compound to a silver halide emulsion does not increase its sensitivity but instead decreases its sensitivity, and hence the super color sensitization is a quite specific phenomenon, requiring careful selection of sensitizing dye(s) and the second organic compound for use in the combination. Accordingly, even a slight difference in chemical structure greatly influences the super color sensitizing action and hence it-is quite difficult to predict a suitable combination for super color sensitization by chemical structures.

Examples of conventional second organic compounds for super color sensitization include triazine derivatives described in U.S. Pat. Nos. 2,875,058 and 3,695,888, mercapto compounds described in U.S. Pat. No. 3,457,078, thiourea compounds described in U.S. Pat. No. 3,458,318, and pyrimidine derivatives described in U.S. Pat. No. 3,615,632. Also, U.S. Pat. No. 4,011,083 discloses an infrared sensitization using a desensitizing amount of infrared sensitizing dye(s) in combination with an azaindene compound.

By the methods described in these patents, the infrared sensitivity of the silver halide emulsions is certainly increased and storage stability may be improved to some extent, but these improvements remain insufficient, and the development of a super color sensitizer providing a greater increase in infrared sensitivity and improvement of storage stability is desired.

In addition, a silver halide emulsion in a liquid state before coating is subject to fogging and sensitivity changes and, in particular, to such changes caused by the desorption and decomposition of sensitizing dyes. Such deterioration of photographic characteristics in a silver halide emulsion in a liquid state before coating is a large problem in the production of photographic light-sensitive materials. Conventional stabilizers, such as 1-phenyl-5-mercaptotetrazole, etc., are ineffective to improve silver halide emulsions containing infrared sensitizing dye(s), which are in a sol state. Accordingly, a technique for strikingly improving the stability of a silver halide emulsion containing infrared sensitizing dye(s), which is in a liquid state before coating, is desired.

SUMMARY OF THE INVENTION

An object of this invention is to provide a silver halide photographic emulsion which is used for a silver halide photographic material having a high sensitivity for infrared light.

Another object of this invention is to provide a silver halide photographic emulsion having reduced sensitivity change in a liquid state before coating and a high sensitivity for infrared light.

Still other object of this invention is to provide a silver halide photographic emulsion which is used for a silver halide photographic light-sensitive material exhibiting reduced fogging and sensitivity change during storage and having a high sensitivity for infrared light.

As the results of various investigations, the inventors have discovered that these and other objects of this invention can be attained by a silver halide photographic emulsion incorporating the combination of at least one infrared- sensitizing dye represented by following formula (I) or (II) and at least one compound represented by following formula (IIIa) or (IIIb):

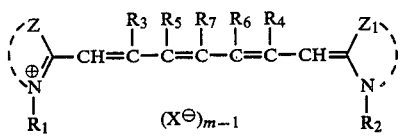

(I)

wherein, $R_1$ and $R_2$, which may be the same or different, each represents an alkyl group or a substituted alkyl group; $R_3$ and $R_4$, which may be the same or different, each represents a hydrogen atom, a lower alkyl group, a lower alkoxy group, a phenyl group, or a benzyl group; $R_5$ and $R_6$ both represent a hydrogen atom or are bonded to form a divalent alkylene group; $R_7$ represents a hydrogen atom, a lower alkyl group, a lower alkoxy group, a phenyl group, a benzyl group, or

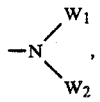

wherein, $W_1$ and $W_2$, which may be the same or different, each represents a substituted or unsubstituted alkyl group or a substituted or unsubstituted aryl group, or such groups may be bonded to form a 5-membered or 6-membered nitrogen-containing heterocyclic ring; $R_3$ and $R_7$ may be bonded to form a divalent alkylene group; Z and $Z_1$ each represents a non-metallic atomic group necessary for forming a 5-membered or 6-membered nitrogen-containing heterocyclic ring $X^{\ominus}$ represents an acid anion; and m represents 1 or 2;

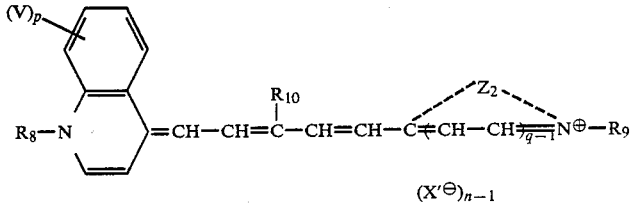

(II)

wherein, $R_8$ and $R_9$, which may be the same or different, each represents an alkyl group or a substituted alkyl group; $R_{10}$ represents a hydrogen atom, a lower alkyl group, a lower alkoxy group, a phenyl group, or a benzyl group; V represents a hydrogen atom, a lower alkyl group, an alkoxy group, a halogen atom, or a substituted alkyl group; $Z_2$ represents a non-metallic atomic group necessary for forming a 5-membered or 6-membered nitrogen-containing heterocyclic ring; $X'^{\ominus}$ represents an acid anion; and n, p, and q, which may be the same or different, each represents 1 or 2;

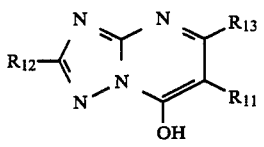

(IIIa)

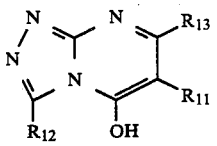

(IIIb)

wherein $R_{11}$ and $R_{12}$ each represents a hydrogen atom, a lower alkyl group, an alkenyl group, a carboxy group, an alkoxy group, or a halogen atom; and $R_{13}$ represents an alkyl group having at least 5 carbon atoms, an aralkyl group, an aryl group, an alkylthio group, an arylthio group, an alkoxy group having at least 3 carbon atoms, an aryloxy group, an alkylamino group having at least 3 carbon atoms, an arylamino group,

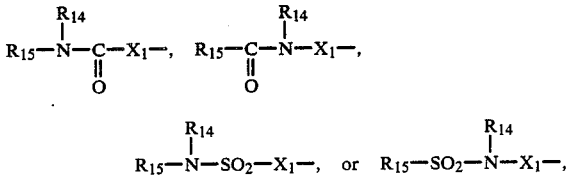

wherein, $X_1$ represents a divalent linkage group, and $R_{14}$ and $R_{15}$, which may be the same or different, each represents a hydrogen atom, an alkyl group, an alkenyl group, an aralkyl group, an aryl group, or a heterocyclic group.

DETAILED DESCRIPTION OF THE INVENTION

The compounds for use in this invention represented by formulae (I), (II), (IIIa), and (IIIb) are now described in greater detail.

In general formula (I) described above, $R_1$ and $R_2$, which may be the same or different, each represents an alkyl group (having, preferably, 1 to 8 carbon atoms, e.g., a methyl group, an ethyl group, a propyl group, a butyl group, a pentyl group, a heptyl group), or an alkyl group substituted with, e.g., carboxy group, a sulfo group, a cyano group, a halogen atom (e.g., a fluorine atom, a chlorine atom, a bromine atom, etc.), a hydroxy group, an alkoxycarbonyl group (having, preferably, 8 or fewer carbon atoms, e.g., a methoxycarbonyl group, an ethoxycarbonyl group, a benzyloxycarbonyl group), an alkoxy group (having, preferably, 7 or fewer carbon atoms, e.g., a methoxy group, an ethoxy group, a propoxy group, a butoxy group, a benzyloxy group), an aryloxy group (e.g., a phenoxy group, a p-tolyloxy group), an acyloxy group (having, preferably, 3 or fewer carbon atoms, e.g., an acetyloxy group, a propionyloxy group), an acyl group (having, preferably, 8 or fewer carbon atoms, e.g., an acetyl group, a propionyl group, a benzoyl group, a mesyl group), a carbamoyl group (e.g., .a carbamoyl group, an N,N-dimethylcarbamoyl group, a morpholinocarbamoyl group, a piperidinocarbamoyl group), a sulfamoyl group (e.g., a sulfamoyl group, an N,N-dimethylsulfamoyl group, a morpholinosulfonyl group), an aryl group (e.g., a phenyl group, a p-hydroxyphenyl group, a p-carboxyphenyl group, a p-sulfophenyl group, an $\alpha$-naphthyl group); the alkyl moiety of such a substituted alkyl group has, preferably, 1 to 6 carbon atoms; and the alkyl group may have 2 or more substituents described above, which may be the same or different.

In formula (I) described above, $R_3$ and $R_4$ each represents a hydrogen atom, a lower alkyl group (having, preferably, 1 to 6 carbon atoms, e.g., a methyl group, an ethyl group, a propyl group), a lower alkoxy group (having, preferably, 1 to 6 carbon atoms, e.g., a methoxy group, an ethoxy group, a propoxy group, a butoxy group), a phenyl group or a benzyl group.

In formula (I), $R_5$ and $R_6$ both represent a hydrogen atom or $R_5$ and $R_6$ are bonded to form an alkylene group (e.g., an ethylene group or a trimethylene group). The alkylene group may be substituted by one or more suitable substituents such as an alkyl group (having, preferably, 1 to 4 carbon atoms, e.g., a methyl group, an ethyl group, a propyl group, an isopropyl group, a butyl group, etc.), a halogen atom (e.g., a chlorine atom, a bromine atom, etc.), and an alkoxy group (having, preferably, 1 to 4 carbon atoms, e.g., a methoxy group, an ethoxy group, a propoxy group, an isopropoxy group, a butoxy group, etc.). As a divalent alkylene group represented by bonding $R_5$ and $R_6$,an ethylene group is preferred.

In formula (I), $R_7$ represents a hydrogen atom, a lower alkyl group (having, preferably, 1 to 8 carbon atoms, e.g., a methyl group, an ethyl group, a propyl group, etc.), a lower alkoxy group (having, preferably, 1 to 8 carbon atoms, e.g., a methoxy group, an ethoxy group, a propoxy group, a butoxy group, etc.), a phenyl group, a benzyl group, or

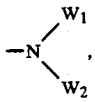

wherein $W_1$ and $W_2$ each represents a substituted or unsubstituted alkyl group (having, preferably, 1 to 18 carbon atoms, and more preferably, 1 to 4 carbon atoms, e.g., a methyl group, an ethyl group, a propyl group, a butyl group, a benzyl group, a phenylethyl group, etc.), or a substituted or unsubstituted aryl group (e.g., a phenyl group, a naphthyl group, a tolyl group, a p-chlorophenyl group, etc.); $W_1$ and $W_2$ may be bonded to form a 5-membered or 6-membered nitrogen-containing heterocyclic ring. $R_7$ may further combine with $R_3$ described above to form a divalent alkylene group that is the same as the divalent alkylene group formed by the combination of $R_5$ and $R_6$ described above. As a divalent alkylene group represented by bonding $R_3$ and $R_7$,

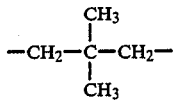

is preferred.

In formula (I), Z and $Z_1$, which may be the same or different, each represents a non-metallic atomic group necessary for forming a 5-membered or 6-membered nitrogen-containing heterocyclic ring. Examples of the heterocyclic ring include a thiazole nucleus (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6 - dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), a selenazole nucleus (e.g., benzoselenazole, 5-chlorobenzoselenazole, 5-methoxybenzoselenazole, 5-methylbenzoselenazole, 5-hydroxybenzoselenazole, naphtho[1,2-d]selenazole, naphtho[2,1-d]selenazole, etc.), an oxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxozole, etc.), a quinoline nucleus (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), a 3,3-dialkylindolenine nucleus (e.g., 3,3-dimethylindolenine, 3,3-diethylindolenine, 3,3-dimethyl-5-cyanoindolenine, 3,3-dimethyl-5-methoxyindolenine, 3,3-dimethyl- 5-methylindolenine, 3,3-dimethyl-5-chloroindolenine, etc.), an imidazole nucleus (e.g, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-methyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethynaphtho[1,2-d]imidazole, etc.), a pyridine nucleus (e.g., pyridine, 5-methyl-2-pyridine, 3-methyl-4-pyridine, etc.), etc.

Of the above-described nuclei, thiazole nuclei, or oxazole nuclei are preferred. More specifically, benzothiazole nuclei, naphthothiazole nuclei, naphthoxazole nuclei, or benzoxazole nuclei are preferred.

In formula (I) described above, $X^{\ominus}$ represents an acid anion. Specific examples of $X^{\ominus}$ in formula (I) are halogen ions (e.g., $Cl^{\ominus}$, $Br^{\ominus}$, $I^{\ominus}$, etc.), a perchlorate ion, a thiocyanate ion, an acetate ion, an ethylsulfate ion, a methylsulfate ion, a benzenesulfonate ion, a toluenesulfonate ion, etc.

In formula (I), m represents 1 or 2. When the compound shown by formula (I) forms a betaine, m is 1.

In formula (II) described above $R_8$ and $R_9$, which may be the same or different, each represents an alkyl group (having, preferably, 1 to 8 carbon atoms, e.g., a methyl group, an ethyl group, a propyl group, a butyl group, a pentyl group,- a heptyl group, etc.) or a substituted alkyl group, where examples of the substituent include a carboxy group, a sulfo group, a cyano group, a halogen atom (e.g., a fluorine atom, a chlorine atom, a bromine atom, etc.), a hydroxy group, an alkoxycarbonyl group (having, preferably, 8 or fewer carbon atoms, e.g., a methoxycarbonyl group, an ethoxycarbonyl group, a benzyloxycarbonyl group, etc.), an alkoxy group (having, preferably, 7 or fewer carbon atoms, e.g., a methoxy group, an ethoxy group, a propoxy group, a butoxy group, a benzyloxy group, etc.), an aryloxy group (e.g., a phenoxy group, p-tolyloxy group, etc.), an acyloxy group (having, preferably, 3 or fewer carbon atoms,. e.g., an acetyloxy group, a propionyloxy group, etc.), an acyl group (having, preferably, 8 or fewer carbon atoms, e.g., an acetyl group, a propionyl group, a benzoyl group, a mesyl group, etc.), a carbamoyl group (e.g., a carbamoyl group, an N,N-dimethylcarbamoyl group, a morpholinocarbamoyl group, a piperidinocarbamoyl group, etc.), a sulfamoyl group (e.g., a sulfamoyl group, an N,N-dimethylsulfamoyl group, a morpholinosulfamoyl group, etc.), an aryl group (e.g., a phenyl group, a p-hydroxyphenyl group, a p-carboxyphenyl group, a p-sulfophenyl group, an $\alpha$-naphthyl group, etc.), etc. The alkyl moiety of the substituted alkyl group has, preferably, 1 to 6 carbon atoms, and the alkyl group may be substituted by two or more such substituents.

In formula (II) described above, $R_{10}$ represents a hydrogen atom, a lower alkyl group (having, preferably, 1 to 6 carbon atoms, e.g., a methyl group, an ethyl group, a propyl group, etc.), a lower alkoxy group (having, preferably, 1 to 6 carbon atoms, e.g., a methoxy group, an ethoxy group, a propoxy group, a butoxy group, etc.), a phenyl group, or a benzyl group. In these groups, a lower alkyl group and a benzyl group are preferred.

In formula (II), V represents a hydrogen atom, a lower alkyl group (having, preferably, 1 to 8 carbon atoms, e.g., a methyl group, an ethyl group, a propyl group, etc.), an alkoxy group (having, preferably, 1 to 8 carbon atoms, e.g., a- methoxy group, an ethoxy group, a butoxy group, etc.), a halogen atom (e.g., a fluorine atom, a chlorine atom, etc.), or a substituted alkyl group (having, preferably, 1 to 8 carbon atoms, e.g., a trifluoromethyl group, a carboxymethyl group, etc.).

In formula (II), $Z_2$ represents a non-metallic atomic group necessary for forming a 5-membered or 6-membered nitrogen-containing heterocyclic ring. Examples of the heterocyclic ring are a thiazole nucleus (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), a selenazole nucleus (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), an oxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), a quinoline nucleus (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), a 3,3-dialkylindolenine (e.g., 3,3-dimethylindolenine, 3,3-diethylindolenine, 3,3-dimethyl-5-cyanoindolenine, 3,3-di-methyl-5-methoxyindolenine, 3,3-dimethyl-5-methylindolenine, 3,3-dimethyl-5-chloroindolenine, etc.), an imidazole nucleus (e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-methyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorbenzimidazole, 1-allyl-5-chlorobenzimidazole, 1-phenylbenzimidazole, 1-phenyl-5-chlorobenzimidazole, 1-methyl-5-trifluromethylbenzimidazole, 1-ethyl-5-trifluoromethylbenzimidazole, 1-ethylnaphtho[1,2-d]imidazole, etc.), a pyridine nucleus (e.g., pyridine, 5-methyl-2-pyridine, 3-methyl-4-pyridine, etc.), etc. As the aforesaid heterocyclic rings, thiazole nuclei and oxazole nuclei are preferred and benzothiazole nuclei, naphthothiazole nuclei, naphthoxazole nuclei and benzoxazole nuclei are more preferred.

In formula (II), $X'^{\ominus}$ represents an acid anion. Specific examples of $X'^{\ominus}$ in formula (II) are halogen ions (e.g., $Cl^{\ominus}$, $Br^{\ominus}$, $I^{\ominus}$, etc.), a perchlorate ion, a thiocyanate ion, an acetate ion, an ethylsulfate ion, a methylsulfate ion, a benzenesulfonate ion, a toluenesulfonate ion, etc.

In formula (II), n, p, and q each represents 1 or 2, and when the compound shown by formula (II) forms a betaine, n is 1.

In formulae (IIIa) and (IIIb), $R_{11}$ and $R_{12}$ each represents a hydrogen atom, a lower alkyl group (preferably a substituted or unsubstituted alkyl group having 1 to 4 carbon atoms, e.g., a methyl group, an ethyl group, a n-propyl group, an isopropyl group, an n-butyl group, a t-butyl group, a methoxyethyl group, a hydroxyethyl group, a hydroxymethyl group, a phenoxymethyl group, etc.), an alkenyl group (preferably, a substituted or unsubstituted alkenyl group having 2 to 4 carbon atoms, e.g., a vinyl group, an allyl group, etc.), a carboxy group, an alkoxy group (preferably, a substituted or unsubstituted alkoxy group having 1 to 5 carbon atoms, e.g., a methoxy group, an ethoxy group, a methoxyethoxy group, a hydroxyethoxy group, etc.), or a halogen atom (e.g., a chlorine atom, a bromine atom, a fluorine atom, etc.).

In formulae (IIIa) and (IIIb), $R_{13}$ represents an alkyl group having at least 5, preferably at least 6 carbon atoms (e.g., a pentyl group, a heptyl group, an octyl group, a dodecyl group, a pentadecyl group, a heptadecyl group, etc.), an aralkyl group (preferably, a substituted or unsubstituted aralkyl group having 7 to 12 carbon atoms, e.g., a benzyl group, a phenethyl group, a phenylpropyl group, etc.), an aryl group (preferably, a substituted or unsubstituted aryl group having 6 to 12 carbon atoms, e.g., a phenyl group, a 4-methylphenyl group, a 4-methoxyphenyl group, etc.), an alkylthio group (preferably, a substituted or unsubstituted alkylthio group having 1 to 10 carbon atoms, e.g., a methylthio group, an ethylthio group, etc.), an arylthio group (preferably, a substituted or unsubstituted arylthio group having 6 to 12 carbon atoms, e.g., a phenylthio group, etc.), an alkoxy group having at least 3 carbon atoms (e.g., a propoxy group, a butoxy group, etc.), an aryloxy group (e.g., a phenoxy group, etc.), an alkylamino group having at least 3 carbon atoms (e.g., a propylamino group, a butylamino group, etc.), an arylamino group (e.g., an anilino group, etc.),

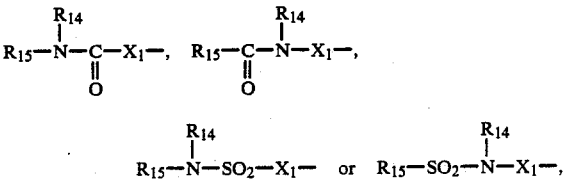

wherein, $X_1$ represents an alkylene linkage group (preferably, having 1 to 5 carbon atoms, e.g., a methylene group, a propylene group, a 2-hydroxypropylene group, etc.), and $R_{14}$ and $R_{15}$, which may be the same or different, each represents a hydrogen atom, an alkyl group (preferably, a substituted or unsubstituted alkyl group having 1 to 10 carbon atoms, e.g., a methyl group, an ethyl group, an n-propyl group, an isopropyl group, an n-butyl group, a t-butyl group, an n-octyl group, a methoxyethyl group, a hydroxyethyl group, etc.), an alkenyl group (preferably, a substituted or unsubstituted alkenyl group having 2 to 10 carbon atoms, e.g., an allyl group, a propalgyl group, etc.), an aralkyl group (preferably, a substituted or unsubstituted aralkyl group having 7 to 12 carbon atoms, e.g., a benzyl group, a phenethyl group, a vinylbenzyl group, etc.), an aryl group (preferably, a substituted or unsubstituted aryl group having 6 to 12 carbon atoms, e.g., a phenyl group, a 4-methylphenyl group, etc.), or a heterocyclic group (e.g., a 2-pyridyl group, etc.).

Specific examples of the sensitizing dye represented by general formula (I) or (II) described above are illustrated below, but the present invention is not to be construed as being limited to these sensitizing dyes.

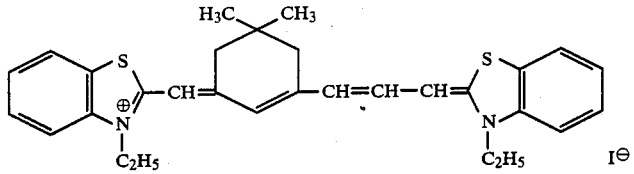

(I-1)

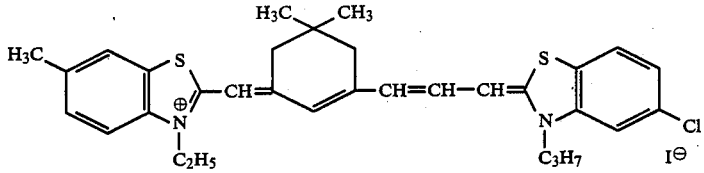

(I-2)

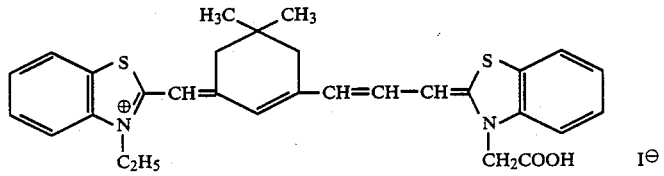

(I-3)

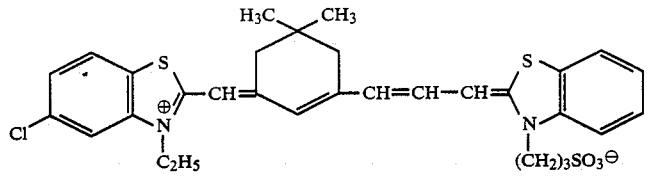

(I-4)

-continued
(I-5)
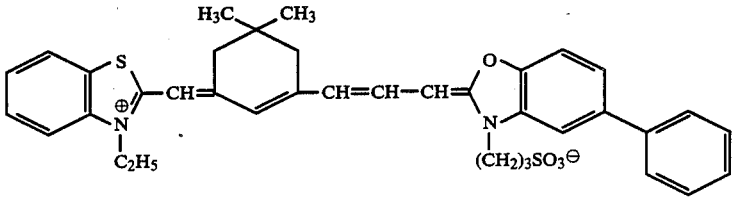
(I-6)
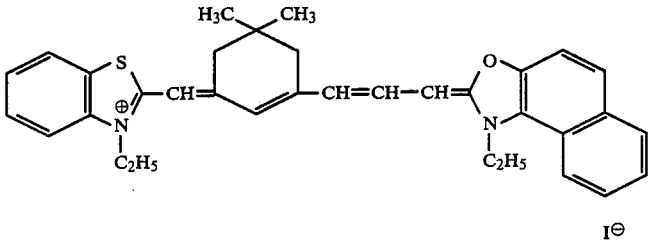
(I-7)
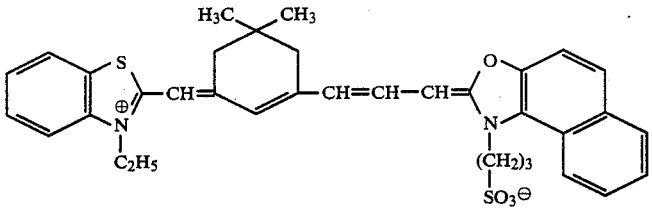
(I-8)
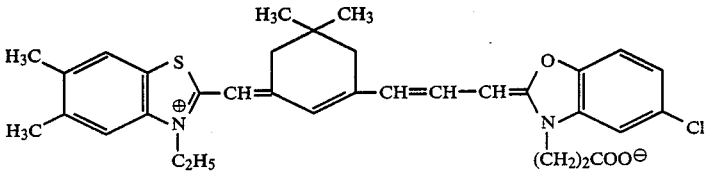
(I-9)
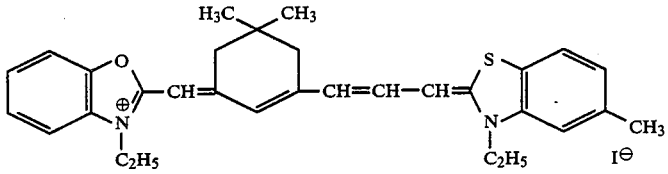
(I-10)
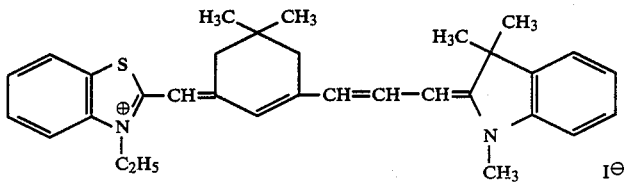
(I-11)
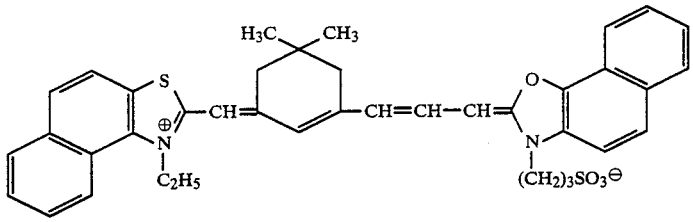

-continued
(I-12)
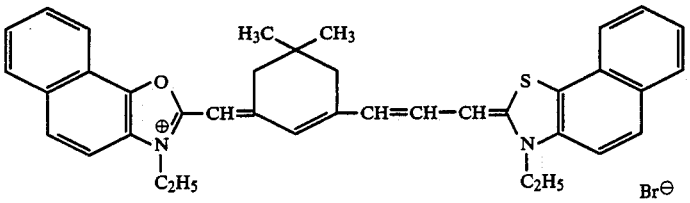
(I-13)
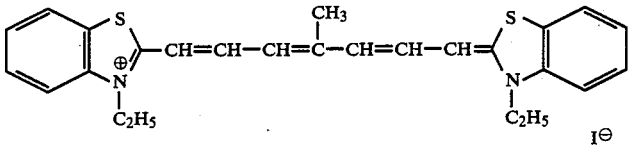
(I-14)
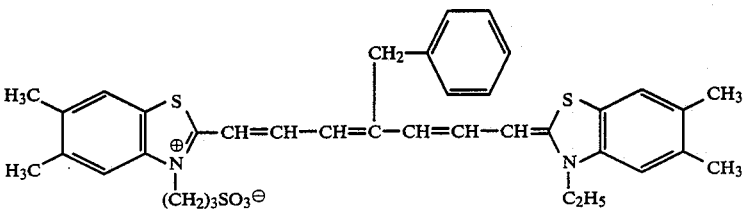
(I-15)
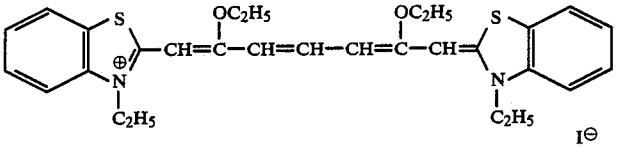
(I-16)
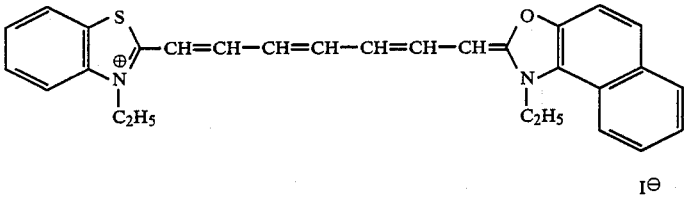
(I-17)
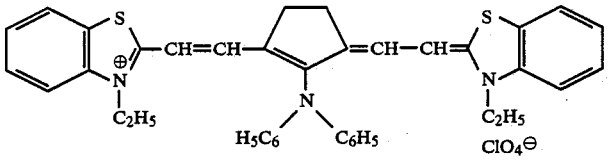
(I-18)
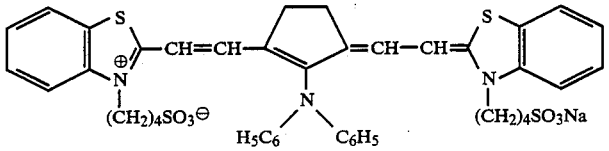
(I-19)
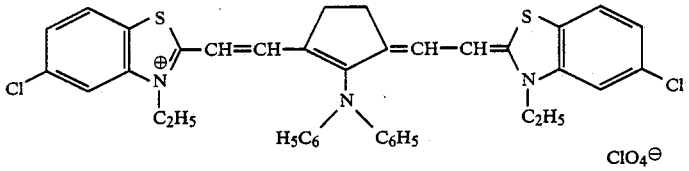

-continued
(I-20)
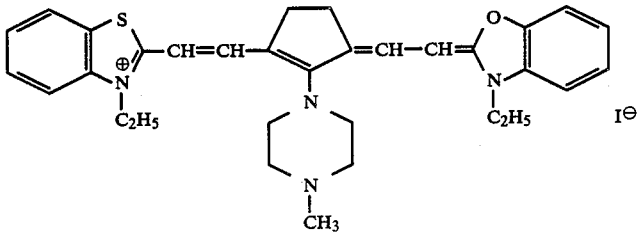
(I-21)
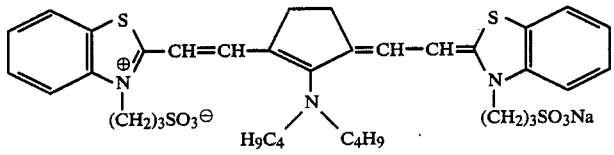
(I-22)
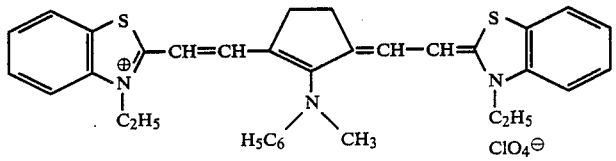
(II-1)
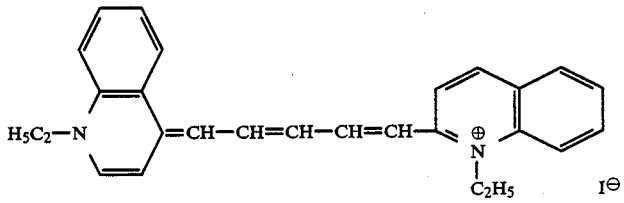
(II-2)
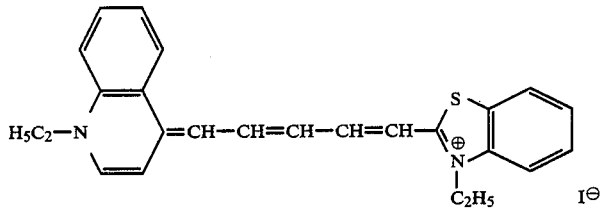
(II-3)
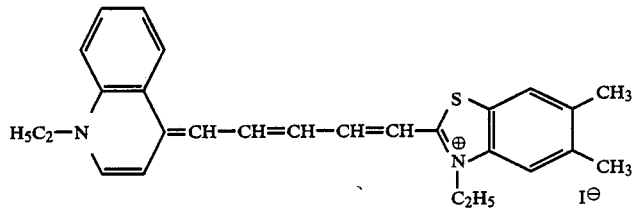
(II-4)
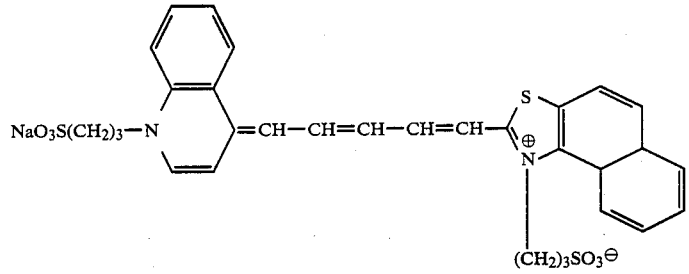

-continued
(II-5)
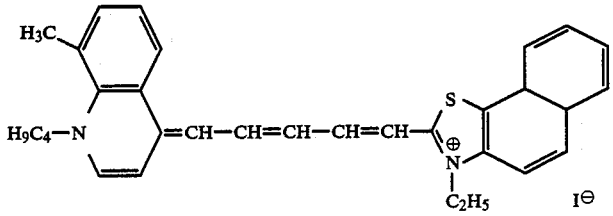
(II-6)
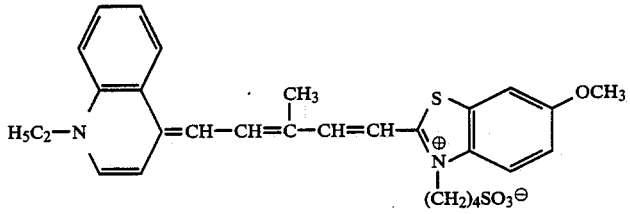
(II-7)
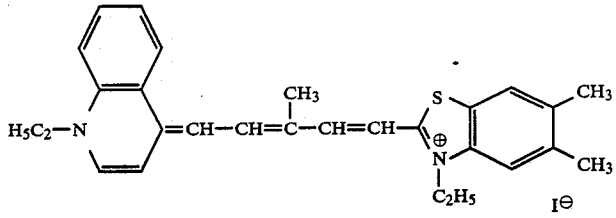
(II-8)
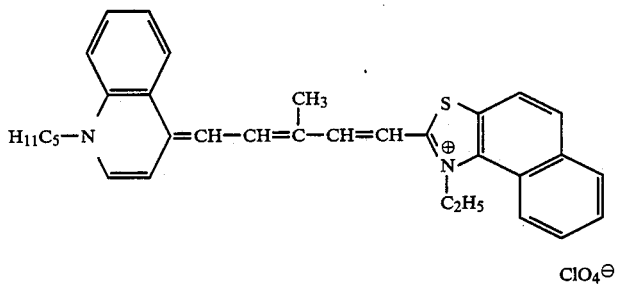
(II-9)
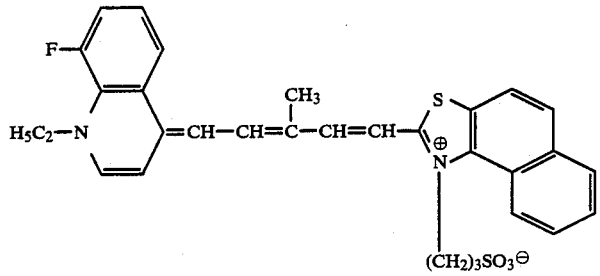
(II-10)
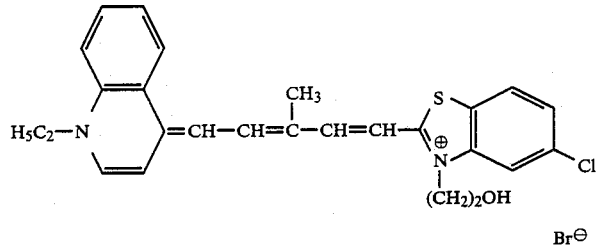

-continued
(II-11)
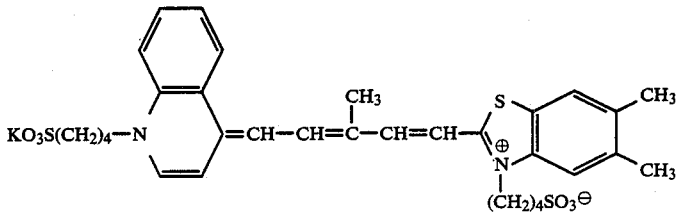
(II-12)
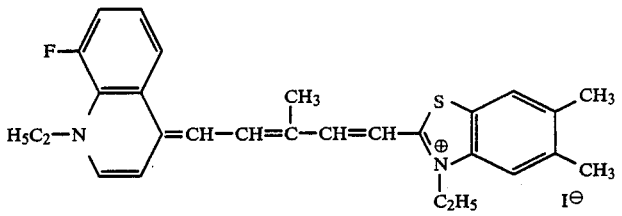
(II-13)
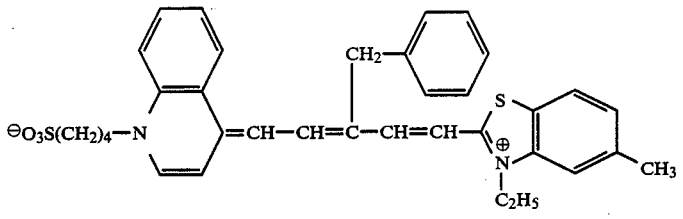
(II-14)
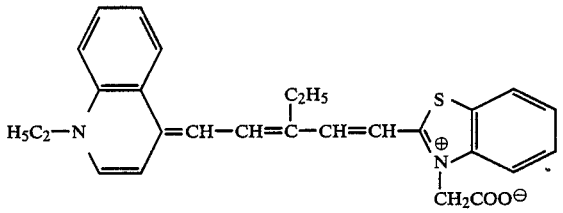
(II-15)
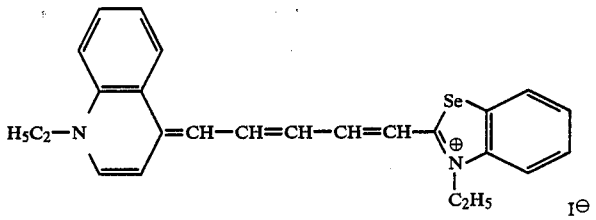
(II-16)
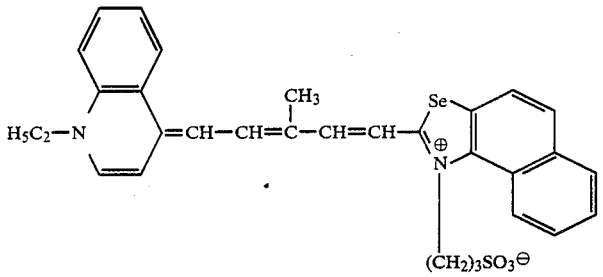

-continued (II-17)

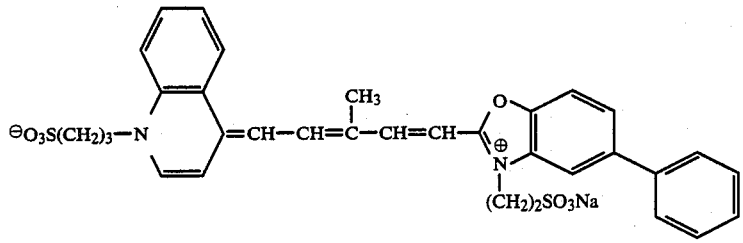

(II-18)

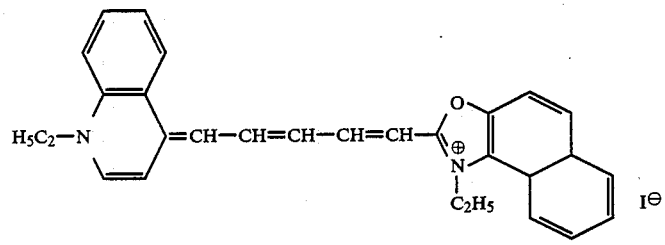

(II-19)

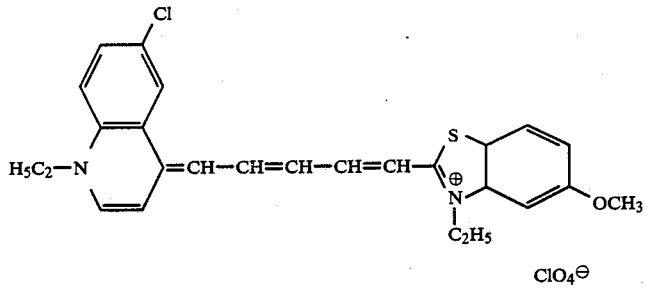

(II-20)

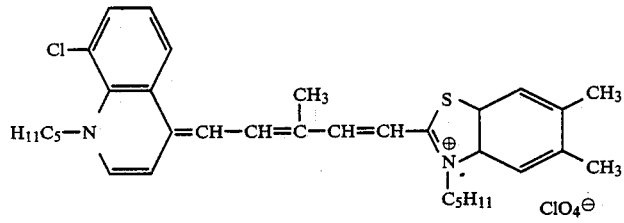

Specific examples of the compounds represented by formulae (IIIa) and (IIIb) described above are illustrated below, but the invention is not to be construed as being limited to these compounds.

(III-1) 4-Hydroxy-6-pentyl-1,3,3a,7-tetraazaindene
(III-2) 4-Hydroxy-6-heptyl-1,3,3a,7-tetraazaindene
(III-3) 4-Hydroxy-6-nonyl-1,3,3a,7-tetraazaindene
(III-4) 4-Hydroxy-6-heptadecyl-1,3,3a,7-tetraazaindene
(III-5) 4-Hydroxy-6-benzyl-1,3,3a,7-tetraazaindene
(III-6) 6-(N,N-Diallylcarbamoylmethyl)-4-hydroxy-1,3,3a,7-tetraazaindene
(III-7) 6-(N-Ethylcarbamoylethyl)-4-hydroxy-2-methyl-1,3,3a,7-tetraazaindene
(III-8) 6-(N- Phenylcarbamoylmethyl)-4-hydroxy-1,3,3a,7-tetraazaindene
(III-9) 6-(N-2-Pyridylcarbamoylmethyl)-4-hydroxy-1,3,3a,7-tetraazaindene
(III-10) 6-(N-Allylcarbamoylmethyl)-2-allyl-4-hydroxy-1,3,3a,7-tetraazaindene
(III-11) 6-(N-Allylcarbamoylmethyl)-4-hydroxy-1,3,3a,7tetraazaindene
(III-12) 4-Hydroxy-2-methylthio-6-(N-vinylbenzylcarbamoylmethyl)-1,3,3a,7-tetraazaindene
(III-13) 4-Hydroxy-6-(N-vinylbenzylcarbamoylmethyl)-1,3,3a,7-tetraazaindene
(III-14) 6-(N,N-Diethylcarbamoylmethyl)-5-ethoxycarbonyl-4-hydroxy-1,3,3a,7-tetraazaindene
(III-15) 4-Hydroxy-6-(N-propylcarbamoylpropyl)-2-phenoxy-1,3,3a,7-tetraazaindene
III-16) 6-(N-Benzylcarbamoylmethyl)-4-hydroxy-1,3,3a,7-tetraazaindene
(III-17) 5-Cyano-6-(N,N-diallylcarbamoylmethyl)-4-hydroxy-1,3,3a,7-tetraazaindene
(III-18) 4-Hydroxy-6-(N-octylcarbamoylmethyl)-2-phenyl-1,3,3a,7-tetraazaindene
(III-19) 6-(N-Benzylcarbamoylmethyl)-5-bromo-4-hydroxy-1,3,3a,7-tetraazaindene
(III-20) 2-Benzyl-6-(N-N-diethoxycarbamoylmethyl)-4-hydroxy-1,3,3a,7-tetraazaindene
(III-21) 6-(N-Allylcarbamoylmethyl)-4-hydroxy-2-dimethylamino-1,3,3a,7-tetraazaindene
(III-22) 6-(N-Benzylcarbamoylmethyl)-4-hydroxy-2-phenylthio-1,3,3a,7-tetraazaindene
(III-23) 4-Hydroxy-6-(M-methyl-N-phenylcarbamoylmethyl)-1,3,3a,7-tetraazaindene (III-24) 4-Hydroxy-6-(N-propylcarbamoylmethyl)-1,3,3a,7-tetraazaindene
(III-25) 6-(N,N-Dipropylcarbamoylmethyl)-4-hydroxy-1,3,3a,7-tetraazaindene
(III-26) 6-(N-Benzyl-N-methylcarbamoylmethyl)-4-hydroxy-1,3,3a,7-tetraazaindene
(III-27)- 6-[N-(2-Methoxyphenyl)-carbamoylmethyl]-4-hydroxy-1,3,3a,7-tetraazaindene
(III-28) 6-[N-(2-Methylphenyl)-carbamoylmethyl]-4-hydroxy-1,3,3a,7-tetraazaindene
(III-29) 6-[N-(2,5-Dimethoxyphenyl)-carbamoylmethyl]-4-hydroxy-1,3,3a,7-tetraazaindene
(III-30) 6-Acetylaminomethyl-4-hydroxy-1,3,3a,7-tetraazaindene
(III-31) 6-(3-Butenoylaminomethyl)-4-hydroxy-1,3,3a,7-tetraazaindene
(III-32) 4-Hydroxy-6-(α-phenylacetylaminomethyl)-1,3,3a,7-tetraazaindene
(III-33) 6-(N,N-Diallylsulfamoylmethyl)-4-hydroxy-1,3,3a,7-tetraazaindene
(III-34) 6-(N-Benzylsulfamoylmethyl)-4-hydroxy-1,3,3a,7-tetraazaindene
(III-35) 4-Hydroxy-6-(methanesulfonamidomethyl)-1,3,3a,7-tetraazaindene
(III-36) 6-Benzenesulfonamidomethyl -4-hydroxy-1,3,3a,7-tetraazaindene
(III-37) 6-(N,N-Diallylcarbamoylmethyl)-4-hydroxy-1,2,3a,7-tetraazaindene
(III-38) 6-(N-Vinylbenzylcarbamoylmethyl)-4-hydroxy-1,2,3a,7-tetraazaindene
(III-39) 6-Acetylaminomethyl)-4-hydroxy-1,2,3a,7-tetraazaindene
(III-40) 6-(3-Btuenoylaminomethyl)-4-hydroxy-1,2,3a,7-tetraazaindene
(III-41) 6-Benzenesulfonamidomethyl-4-hydroxy-1,2,3a,7-tetraazaindene
(III-42) 6-(N-Allylsulfamoyl)-4-hydroxy-1,2,3a,7-tetraazaindene General synthesis methods for the infrared sensitizing dyes represented by formula (I) or (II) are described, for example, in Japanese Patent Application (OPI) No. 192242/84, etc. The term "OPI" as used herein refers to an "unexamined published Japanese patent application"

The infrared sensitizing dye for use in this invention represented by formula (I) or (II) described above is incorporated in a silver halide photographic emulsion in an amount of, preferably from about $5\times10^{-7}$ mol to $5\times10^{-3}$ mol, more preferably from about $1\times10^{-6}$ mol to $1\times10^{-3}$ mol, and most preferably from about $2\times10^{-6}$ mol to $5\times10^{-4}$ mol per mol of the silver halide in the emulsion.

The infrared sensitizing dye for use in this invention can be directly dispersed in a silver halide emulsion or may be added to a silver halide emulsion in the form of a solution thereof- in a proper solvent such as methanol, ethanol, methylcellosolve, acetone, water, pyridine, a mixture thereof, etc. Also, for dissolving the dye, ultrasonic sound may be utilized. Furthermore, the methods for adding the infrared sensitizing dye according to this invention to silver halide emulsions, include, for example, a method of dissolving the dye in a volatile organic solvent, dispersing the solution in an aqueous solution of a hydrophilic colloid, and adding the dispersion to a silver halide emulsion as described in U.S. Pat. No. 3,469,987; a method of dispersing the water-insoluble dye in a water-soluble solvent without dissolving it in the solvent and adding the dispersion to a silver halide emulsion as described in Japanese Patent Publication No. 24185/71, etc.; a method of dissolving the dye in a surface active agent and adding the solution to a silver halide emulsion as described in U.S. Pat. No. 3,822,135; a method of dissolving the dye using a compound capable of red-shifting and adding the solution to a silver halide emulsion as described in Japanese Patent Application (OPI) No. 74624/76; and a method of dissolving the dye in an acid substantially free from water and adding the solution to a silver halide emulsion as described in Japanese Patent Application (OPI) No. 80826/75. Still further, the methods described in U.S. Pat. Nos. 2,912,343, 3,342,605, 2,996,287, 3,429,835, can be also used for adding the infrared sensitizing dyes for use in this invention to silver halide emulsions.

Also, while infrared sensitizing dye may be uniformly dispersed in a silver halide emulsion before coating on a proper support, the dye may be dispersed in a silver halide emulsion in any step of the preparation of the emulsion.

General synthesis methods for the compounds shown by formula (IIIa) or (IIIb) for use in this invention are described, for example, in *Berichte der Deutschen Chemischen Gesellshaft,* 42, 4638 (1909), *Photo-Rundsch,* 26, pages 414, 437 and 465 (1961), etc.

A synthesis example of a typical compound for use in this inventio-n is illustrated below but other compounds shown by formula (IIIa) or (IIIb) also can be easily synthesized according to the following synthesis example.

SYNTHESIS EXAMPLE

Synthesis of 6-(N,N-diallylcarbamoylmethyl)-4-hydroxy-1,3,3a,7-tetraazaindene (III-6):

A mixture of 126 g of aminotriazole, 304 g of diethyl acetonedicarboxylate, and 60 ml of acetic acid was refluxed for 8 hours. After cooling the mixture, 500 ml of ethyl acetate was added to the mixture and the resultant mixture was allowed to stand, whereby white crystal precipitated. The crystals thus formed were collected by filtration and washed with ethyl acetone to provide 305 g of 6-ethoxycarbonylmethyl-4-hydroxy-1,3,3a,7-tetraazaindene. Then, 300 g of the crystals thus obtained wax mixed with 130 g of sodium hydroxide and 500 ml of water and the mixture was heated to 80° C. for 3 hours. After the reaction was completed, 340 ml of concentrated hydrochloric acid (36%) was slowly added to the reaction mixture to precipitate white crystals. The crystals were collected by filtration and recrystallized from water to provide 212 g of 6-carboxymethyl-4-hydroxy-1,3,3a,7-tetraazaindene.

Then, 143 g of the crystals thus obtained were mixed with 72 g of diallylamine and 1.5 liters of dimethylformamide and the mixture was stirred at room temperature to dissolve the crystals. To the solution was added dropwise 152 g of- N,N-dicyclohexylcarbodiimide and thereafter the mixture was stirred for 8 hours at room temperature to deposit white crystals (N,N-dicyclohexylurea). The crystals thus deposited were filtered away and the filtrate formed was poured into 3 liters of water to deposit white crystals, which were collected by filtration and recrystallized from acetonitrile to provide 171 g of the desired 6-(N,N-diallylcarbamoylmethyl)-4-hydroxy-1,3,3a,7-tetraazaindene.

The product was confirmed to be the desired compound by infrared absorption analysis, nuclear magnetic resonance analysis, and element analysis.

Elemental Analysis for $C_{13}H_{15}N_5O_2$:

| | H | C | N |
|---|---|---|---|
| Calculated: | 5.53% | 57.13% | 25.62% |
| Found: | 5.48% | 57.23% | 25.58% |

The compound for use in this invention shown by formula (IIIa) or (IIIb) described above is advantageously used in an amount of from about 0.01 g to about 5 g per mol of the silver halide in the emulsion.

The ratio of the infrared sensitizing dye represented by formula (I) or (II) described above to the compound represented by formula (IIIa) or (IIIb) described above (dye/compound) is preferably from about 1/1 to 1/300, and more preferably from about ½ to 1/100 by weight.

The compound for use in this invention shown by formula (IIIa) or (IIIb) can be directly dispersed in a silver halide emulsion or can be added to the emulsion as a solution thereof in a proper solvent such as water, methanol, ethanol, propanol, methylcellosolve, acetone, etc., or a mixture thereof Furthermore, the compound may be added to the emulsion in the form of another solution or as a colloidal dispersion as described above for the addition of the sensitizing dyes.

The addition of the compound shown by formula (IIIa) or (IIIb) to a silver halide emulsion may be before or after the addition of the infrared sensitizing dye shown by formula (I) or (II). Also, the compound shown by formula (IIIa) or (IIIb) and the sensitizing dye shown by formula (I) or (II) may be separately dissolved in each solvent and the solutions may be separately or simultaneously added to a silver halide emulsion or may be added to the emulsion as a mixture of the solutions.

The infrared sensitizing dye for use in this invention shown by formula (I) or (II) may be used together with other sensitizing dye(s) such as those described in U.S. Pat. Nos. 3,703,377, 2,688,545, 3,397,060, 3,615,635, and 3,628,964, British Patent Nos. 1,242,588 and 1,293,682, Japanese Patent Publication Nos. 4936/68, 14030/69, 10773/68, and 4930/68, and U.S. Pat. Nos. 3,416,927, 3,615,613, 3,615,632, 3,617,295, and 3,635,721.

The silver halide for use in this invention may be any of silver chloride, silver bromide, silver iodide, silver chlorobromide, silver chloroiodide, silver iodobromide, silver chloroiodobromide, etc. In this invention, silver chloroiodobromide, silver chlorobromide, or silver iodobromide is preferred. Silver chlorobromide or silver chloroiodobromide containing 0 to about 1 mol % silver iodide is more preferably used in this invention.

The added amount of the silver halide of the present invention is not particularly limited, but is generally 0.1 $g/m^2$ to 10 $g/m^2$ as a silver amount.

The silver halide for use in this invention may have coarse grain, fine grain, or a mixture of these grains. These silver halide grains can be formed, for example, a single jet method, a double jet method, or a controlled double jet method.

The silver halide grains for use in this invention may have uniform phase throughout the whole grain or may have different phases in the inside and the surface layer thereof. The silver halide grains may be conversion type grains as described in British Patent No. 635,841 and U.S. Pat. No. 3,622,318. Furthermore, the silver halide grains may be of a type forming latent images mainly on the grain surface or of an internal latent image type forming latent images mainly in the inside of the grain.

These silver halide emulsions can be prepared by various methods such as an ammonia method, a neutralization method, an acid method, etc., described in Mees, *The Theory of the Photographic Process,* (Macmillan (1967)), Grafkides, *Photographic Chemistry,* (Fauntain Press (1967)), *Research Disclosure,* Vol 176, RD No. 17643 (December, 1978), etc.

In this invention, it is preferred that the silver halide emulsion used have a monodisperse grain distribution.

The mean diameter (measured by, e.g., a projected area method, a number average method, etc.) of the silver halide grains is preferably from about 0.04 μm to about 4 μm, particularly preferably not more than about 0.7μm.

For controlling the growth of silver halide grains when forming the grains, a silver halide solvent can be used, including, e.g., ammonia, potassium thiocyanate, ammonium thiocyanate, thioether compounds (described, e.g., in U.S. Pat. Nos. 3,271,157, 3,574,628, 3,704,130, 4,297,439, and 4,276,374), thion compounds (described, e.g., in Japanese Patent Application (OPI) Nos. 144319/78, 82408/78 and 77737/80), and amine compounds (described, e.g., in Japanese Patent Application (OPI) No. 100717/79).

Also, during the formation of the silver halide grains or before or after the formation of the grains, a water-soluble rhodium compound and/or a water-soluble iridium compound may be added to the system.

The silver halide photographic emulsions for use in this invention can be chemically sensitized by ordinary chemical sensitizing methods such as gold sensitization (described in U.S. Pat. Nos. 2,540,085, 2,597,876, 2,597,915, and 2,399,083), sensitization by a metal ion belonging to group VIII of the periodic table (described in U.S. Pat. Nos. 2,448,060, 2,540,086, 2,566,245, 2,566,263, and 2,598,079), sulfur sensitization (described in U.S. Pat. Nos. 1,574,944, 2,278,947, 2,440,206, 2,521,926, 3,021,215,. 3,038,805, 2,410,689, 3,189,458, 3,415,649, and 3,635,717), reduction sensitization (described in U.S. Pat. Nos. 2,518,698, 2,419,974, and 2,983,610, *Research Disclosure,* Vol. 176, RD No. 17643, Paragraph III (December, 1978)), sensitization by thioether compounds (described in U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,671,260, 3,574,709, 3,625,697, 3,635,717, and 4,198,240), and a combination of any of these.

Furthermore, chemical sensitizers can be used, including sulfur sensitizers such as allyl thiocarbamide, thiourea, sodium thiosulfate, thioether, cystine, etc., noble metal sensitizers such as potassium chloroaurate, aurous thiosulfate, potassium chloropalladate, etc., and reduction sensitizers such as tin chloride, phenylhydrazine, reductone, etc.

Other sensitizers such as polyoxyethylene derivatives (described in British Patent No. 981,470, Japanese Patent Publication No. 6475/56, U.S. Pat. No. 2,716,062), polyoxypropylene derivatives, and derivatives having a quaternary ammonium group may be also used.

The silver halide photographic emulsions for use in this invention may contain various compounds for preventing the reduction of sensitivity and the formation of fog during the production, storage, and processing of photographic light-sensitive materials. Examples of these compounds include nitrobenzimidazole, ammonium chloride platinate, 4-hydroxy-6-methyl-1,3,3a,7-tetraazaindene, 3-methylbenzothiazole, 1-phenyl-5-mercaptotetrazole, heterocyclic compounds, mercury-containing compounds, mercapto compounds, metal salts, etc. Specific examples of the compounds which can be used in this invention are described in K. Mees, *The Theory of the Photographic Process,* pages 344–349 (3rd ed., 1966), and other sources cited therein. Other examples of compounds which can be used in this invention for these purposes are thiazolium salts described in U.S. Pat. Nos. 2,131,038 and 2,694,716, azaindenes described in U.S. Pat. Nos. 2,886,437 and 2,444,605, urazoles described in U.S. Pat. No. 3,287,135, sulfocatechols described in U.S. Pat. No. 3,236,652, oximes described in British Patent No. 623,448, mercaptotetrazoles, nitron, and nitronindazoles described in U.S. Pat. Nos. 2,403,927, 3,266,897, and 3,397,987, polyvalent metal salts described in U.S. Pat. No. 2,839,405, thiuronium salts described in U.S. Pat. No.3,220,839, and salts of palladium, platinum and gold described in U.S. Pat. Nos. 2,566,263, and 2,597,915.

The silver halide photographic emulsions for use in this invention can further-contain a developing agent, such as hydroquinones, catechols, aminophenols, 3-pyrazolidones, ascorbic acid and derivatives thereof, reductones, phenylenediamines, and combinations thereof.

The developing agent can be incorporated in the silver halide emulsion layer and/or other photographic layer(s) (e.g., a protective layer, an interlayer, a filter layer, an antihalation layer, a back layer, etc.). The developing agent can be added to the coating composition of the aforesaid layer as a solution in a proper solvent or in the form of a dispersion as described in U.S. Pat. No. 2,592,368 and French Patent No. 1,505,778.

The silver halide emulsions for use in this invention may further contain a development accelerator such as the compounds described in U.S. Pat. Nos. 3,288,612, 3,333,959, 3,345,175, and 3,708,303, British Patent No. 1,098,748, and West German Patent Nos. 1,141,531, and 1,183,784.

The silver halide emulsions for use in this invention can be hardened by any conventional method. Examples of hardening agents which can be used for hardening the emulsions include aldehyde series compounds such as formaldehyde, glutaraldehyde, etc., ketone compounds such as diacetylcyclopentanedione, etc., compounds containing reactive halogen such as bis(2-chloroethylurea), 2-hydroxy-4,6-dichloro-1,3,5-triazine, and the compounds described in U.S. Pat. Nos. 3,288,775 and 2,732,303, British Patent Nos. 974,723 and 1,167,207, compounds having reactive olefins such as divinylsulfone, 5-acetyl-1,3-diacryloylhexahydro-1,3,5-triazine, and the compounds described in U.S. Pat. Nos. 3,635,718 and 3,232,763, British Patent No. 994,869, N-methylol compounds such as N-hydroxymethylphthalimide and the compounds described in U.S. Pat. Nos. 2,732,316 and 2,586,168, isocyanates described in U.S. Pat. No.3,103,437, aziridine compounds described in U.S. Pat. Nos. 3,017,280 and 2,983,611, acid derivatives as described in U.S. Pat. Nos. 2,725,294 and 2,725,295, carbodiimide series compounds as described in U.S. Pat. No. 3,100,704, epoxy compounds described in U.S. Pat. No. 3,091,537, isooxazole series compounds as described in U.S. Pat. Nos. 3,321,313 and 3,543,292, halogenocarboxyaldehydes such as mucochloric acid, etc., dioxane derivatives such as dihydroxydioxane, dichlorodioxane, etc., and inorganic hardening agents such as chromium alum, zirconium sulfate, etc.

Instead of these hardening agents, compounds in he form of precursors for hardening agents, such as alkali metal bisulfite-aldehyde addition products, methylol derivatives of hydantoin, primary aliphatic nitroalcohols, etc., may be used in this invention.

The silver halide emulsions of this invention may further contain surface active agents alone or in combination.

These surface active agents are used as coating aids but are sometimes used for other purposes such as the improvement of dispersibility and sensitizing photographic characteristics, static prevention, sticking prevention, etc. Examples of surface active agents that can be used include natural surface active agents such as saponin, nonionic surface active agents such as alkylene oxide series, glycerine series, glycidol series surface active agents, etc., cationic surface active agents such as higher alkylamines, quaternary ammonium salts, pyridine and other heterocyclic compounds, phosphonium or sulfonium compounds, etc., anionic surface active agents containing an acidic group such as carboxylic acid, sulfonic acid, phosphoric acid, sulfuric acid ester group, phosphoric acid ester group, etc., and amphoteric surface active agents such as aminoacids, aminosulfonic acids, sulfuric acid esters or phosphoric acid esters of aminoalcohols, etc.

Specific examples of these surface active agents which can be used for the emulsions of this invention are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, and 3,545,974, German Patent (OLS) No. 1,942,665, British Patents 1,077,317 and 1,198,450, Japanese Patent Publication No. 44411/81, Ryohei Oda, *Kaimenkasseizai to Sono Oyoo* (*Syntheses of Surface Active Agents and Application Thereof*) (Maki Shoten (1964)), A. W. Pery, *Surface Active Agents* (Interscience Publication Incorporated (1958)), J. P. Sisley, *Encyclopedia of Surface Active Agents,* Vol, 2 (Chemical Publishing Company (1964)).

The silver halide photographic emulsions of this invention preferably contain gelatin as a protective colloid but other protective colloids can be also used. Examples of suitable colloids include acylated gelatin such as phthalated gelatin and malonated gelatin, cellulose compounds such as hydroxyethyl cellulose, carboxymethyl cellulose, etc., soluble starches such as dextrin, etc., and hydrophilic polymers such as polyvinyl alcohol, polyvinylpyrrolidone, polyacrylamide, polystyrenesulfonic acid, etc.

For the silver halide photographic emulsions of this invention, polyalkylene oxide compounds are preferably used for various purposes such as providing high contrast image and increasing sensitivity.

Examples of suitable polyalkylene oxide compounds are the condensation product of a polyalkylene oxide composed of alkylene oxides having 2 to 4 carbon atoms such as ethylene oxide, propylene-1,2-oxide, butylene-1,2-oxide, etc., each preferably containing at least 10 units of ethylene oxides, and a compound having at least one active hydrogen atom, such as water, an aliphatic alcohol, an aromatic alcohol, a fatty acid, an organic amine, a hexytol derivative. A block copolymer of two or more kinds of polyalkylene oxides may also be used.

Specific examples of the polyalkylene oxide compound are as follows:

Polyalkylene glycols
Polyalkylene glycol alkyl ethers
Polyalkylene glycol aryl ethers
Polyalkylene glycol alkylaryl ethers
Polyalkylene glycol esters
Polyalkylene glycol fatty acid amides
Polyalkylene glycolamines
Polyalkylene glycol block copolymers
Polyalkylene glycol graft polymers It is necessary that the molecular weight of the polyalkylene oxide compound be at least about 600.

The polyalkylene oxide compound may contain not only one but also two or more polyalkylene oxide chains in the molecule. In this case, each polyalkylene oxide chain may be composed of less than 10 polyalkylene oxide units, but the sum of alkylene oxide units in the molecule of the polyalkylene oxide compound must be at least 10. When the polyalkylene oxide compound has at least two polyalkylene oxide chains in the molecule, each alkylene oxide chain can be composed of different alkylene oxide units, for example, they may be composed of ethylene oxide and propylene oxide, respectively.

The polyalkylene oxide compound which can be used in this invention preferably contains from about 14 to 100 alkylene oxide units.

Practical examples of the polyalkylene compounds which can be used in this invention are illustrated below.

$HO(CH_2CH_2O)_{90}H$ P-1

$C_4H_9O(CH_2CH_2O)_{15}H$ P-2

$C_{12}H_{25}O(CH_2CH_2O)_{15}H$ P-3

$C_{18}H_{37}O(CH_2CH_2O)_{15}H$ P-4

$C_{18}H_{37}O(CH_2CH_2O)_{40}H$ P-5

$C_8H_{17}CH{=}CHC_8H_{16}O(CH_2CH_2O)_{15}H$ P-6

P-7

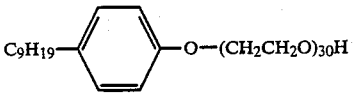

P-8

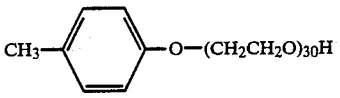

P-9

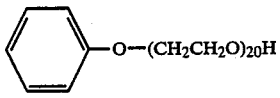

$C_{11}H_{23}COO(CH_2CH_2O)_{80}H$ P-10

$C_{11}H_{23}COO(CH_2CH_2O)_{24}OCC_{11}H_{23}$ P-11

P-12

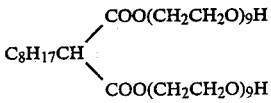

$C_{11}H_{23}CONH(CH_2CH_2O)_{15}H$ P-13

P-14

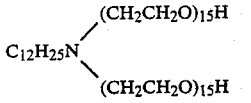

$C_{14}H_{29}N(CH_3)(CH_2CH_2O)_{24}H$ P-15

-continued

P-16

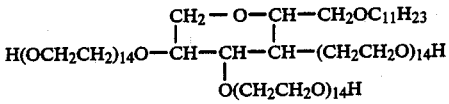

P-17

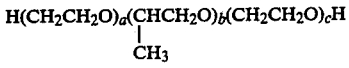

where a + b + c = 50
b:a + c = 10:9

P-18

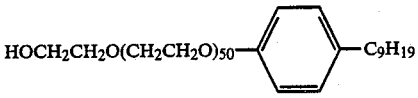

P-19

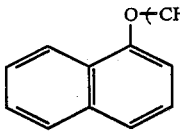

$HO(CH_2CH_2O)_a(CH_2CH_2CH_2CH_2O)_b(CH_2CH_2O)_cH$ P-20
where a + b = 30, b = 14

$HO(CH_2CH_2O)_a(CHCH_2O)_b(CH_2CH_2O)_cH$ P-21

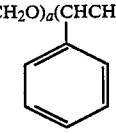

where b = 8, a + c = 50

P-22

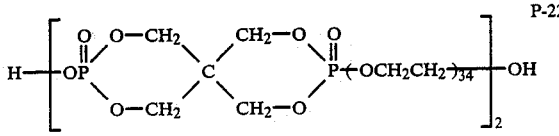

P-23

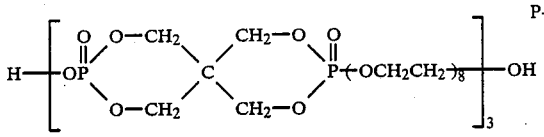

$HO\text{-}(CH_2CH_2O)_{34}\text{-}H$ P-24

There polyalkylene oxide compounds are described in Japanese Patent Application (OPI) Nos. 156423/75, 108130/77 and 3217/78. These polyalkylene oxide compounds may be used alone or in combination.

For adding the polyalkylene oxide compound to a silver halide emulsion, the compound can be added to a silver halide emulsion as an aqueous solution thereof or a solution in a low-boiling organic solvent miscible with water in a proper step before coating, preferably after chemical ripening of the emulsion.

It is preferred that the content of the polyalkylene oxide compound be in the range of from about $1\times10^{-5}$ mol to $1\times10-2$ mol per mol of the silver halide in the emulsion.

Also, the silver halide emulsions of this invention may further contain a polymer latex composed of a homopolymer or a copolymer of an alkyl acrylate, an alkyl methacrylate, acrylic acid, glycidyl acrylate, etc., as described in U.S. Pat. Nos. 3,411,911, 3,411,912, 3,142,568, 3,325,286 and 3,547,650, and Japanese Patent Publication No. 5331/70, for improving the dimensional stability and layer properties of the photographic light-sensitive material containing the emulsion of this invention.

The silver halide photographic emulsions of this invention may further contain antistatic agents, plasticizers, fluorescent whitening agents, air fog preventing agents, toning agents, etc.

The silver halide photographic emulsions may further contain color couplers such as cyan couplers, magenta couplers, and yellow couplers, and compounds dispersing these couplers.

That is, the silver halide emulsion of this invention may contain a compound capable of coloring by oxidative coupling with an aromatic primary amine developing agent (e.g., a phenylenediamine derivative, an aminophenol derivative, etc.) in a color development process. It is preferred that the coupler be rendered non-diffusible by having a hydrophobic group as a ballast group in the molecule. The coupler may be either 4-equivalent or 2-equivalent for silver ions. Also, the coupler may be a colored coupler having a color correction effect or a DIR coupler releasing a development inhibitor upon color development.

Furthermore, the silver halide photographic emulsion of this invention may contain a non-coloring DIR coupling compound which gives a colorless coupling reaction product and releases a development inhibitor.

The silver halide photographic emulsions of this invention also can be used for forming color images by development with color developers containing diffusible couplers.

Also, the silver halide photographic emulsions of this invention may contain irradiation preventing dyes such as those described, for example, in Japanese Patent Publication Nos. 20389/66, 3504/68, and 13168/68, U.S. Pat. Nos. 2,697,037, 3,423,207 and 2,865,752, and British Patent No. 1,030,392 and 1,100,546.

This invention includes both black and white photographic emulsions and silver halide emulsions which are used for various color photographic light-sensitive materials.

Also, the silver halide photographic emulsions of this invention may be used together with other silver halide emulsions having sensitivity in other spectral regions for forming multilayer multicolor photographic materials.

For obtaining photographic images using the silver halide photographic emulsion(s) of this invention, an ordinary light exposure source may be applied, i.e., any light source producing infrared light, such as natural light (sunlight), a tungsten lamp, a mercury lamp, a xenon arc lamp, a carbon arc lamp, a xenon flash lamp, a cathode ray tube flying spot, a light emitting diode, or laser light (e.g., gas laser, dye laser, YAG laser, semiconductor laser, etc.). Also light emitted from a fluorescent source excited by electron beams, X-rays, gamma rays, $\alpha$-rays, etc., can be used as the light source.

The exposure time may be, as a matter of course, from about 1/1000 sec. to 1 sec. for an ordinary camera, or shorter than 1/1000 sec., for example, from about $1/10^4$ to $1/10^6$ sec. using a xenon flash lamp or a cathode ray tube, or may be longer than 1 sec., as desired.

If desired, the spectral composition of light for exposing the light-sensitive material using the silver halide emulsion(s) of this invention can be controlled by color filter(s).

The silver halide photographic emulsion(s) of this invention may be coated on any conventional flexible support such as a plastic film (e.g., cellulose nitrate film, cellulose acetate film, polyethylene terephthalate film, etc.), a paper, a baryta-coated paper, a resin-coated paper, etc., or on a solid support such as a glass plate, etc. Details of suitable supports and coating methods are described, for example, in *Research Disclosure,* Vol. 176, RD No. 17643, Items XV (page 27) and Item XVII (page 28) (December, 1978).

Photographic light-sensitive materials using the silver halide emulsions of this invention can be processed by known processing methods using known processing solutions. The processing temperature is usually selected between about 18° C. and 50° C. but may be lower than 18° C. or higher than 50° C. The photographic processing may be black and white photographic processing forming silver images, color photographic processing forming dye images, or lithographic development processing.

Details of photographic processing methods which can be employed for forming images using the photographic emulsions of this invention are described, for example, in *Research Disclosure,* Vol. 176, RD No. 17643, pages 28–29, ibid., Vol. 187, RD No. 18716, page 651.

The silver halide photographic emulsions of this invention can be used for low-silver photographic light-sensitive materials containing silver halide in an amount from about ½ to about 1/100 of an ordinary silver halide content.

The following examples are intended to illustrate this invention in more detail, but are not to be construed as limiting it in any way.

EXAMPLE 1

A silver iodobromide emulsion (iodide content 1.0 mol %) was prepared by precipitating silver halide grains by a double jet method, and after physical ripening and desalting, chemically ripening the silver halide grains. The mean diameter of the silver halide grains contained in the emulsion was 0.4 micron, and the content of the silver halide was 0.6 mol per kg of the emulsion.

A heating 1 kg of the emulsion to 40° C., the sensitizing dye represented by formula (I) described above and a methanol solution containing the compound represented by formula (IIIa) or (IIIb) described above or Comparison Compound A were added to the emulsion in a definite amount as shown in Table 1 described below, followed by stirring. Then, 35 ml of an aqueous solution containing 1.0% by weight of 1-hydroxy-3,5-dichlorotriazine sodium salt was added to the mixture, and further 50 ml of a 1.0 wt % aqueous solution of sodium dodecylbenzenesulfonate was added thereto followed by stirring.

The finished silver halide emulsion was coated on a cellulose triacetate film base at a dry thickness of 5 microns and dried to provide a light-sensitive material. The film sample obtained was wedge-exposed using a sensitometer having a light source (color temperature 2854° K.) equipped with a dark red filter (SC-72) made by Fuji Photo Film Co., Ltd.

After the exposure, the film sample was developed using a developer having the following composition for 3 minutes at 20° C., stopped, fixed, and further washed with water to provide a strip having desired black and white images. Then, the density of the strip was measured by a standard method using a P-Type densitometer made by Fuji Photo Film Co., Ltd. to determine sensitivity and fog, using [fog+0.3] as the standard optical density for determining sensitivity. Composition of the developer:

| Composition of the developer: | |
|---|---|
| Water | 500 ml |
| N-Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |
| Water to make | 1 liter |

The results obtained are shown in Table 1 below as relative values As shown in the table, the combination according to the present invention provided a light-sensitive material having a remarkably high sensitivity without an increase in fog as compared with the comparison examples Compound A used as the comparison compound was 4-hydroxy-6-methyl-1,3,3a,7-tetraazaindene.

TABLE 1

| | Sensitizing Dye of Formula (I) | | Compound of Formula (IIIa) or (IIIb) | | | |
|---|---|---|---|---|---|---|
| No. | Kind | Amount ($\times 10^{-5}$ mol/mol Ag) | Kind | Amount (g/mol Ag) | Sensitivity | Fog |
| 1 | I-1 | 4.8 | — | — | 100 | 0.07 |
| 2 | " | " | III-1 | 0.32 | 148 | 0.07 |
| 3 | " | " | " | 0.64 | 174 | 0.06 |
| 4 | " | " | III-6 | 0.32 | 151 | 0.07 |
| 5 | " | " | " | 0.64 | 178 | 0.06 |
| 6 | " | " | III-12 | 0.32 | 155 | 0.07 |
| 7 | " | " | " | 0.64 | 178 | 0.06 |
| 8 | " | " | III-25 | 0.32 | 151 | 0.07 |
| 9 | " | " | " | 0.64 | 186 | 0.06 |
| 10 | " | " | III-33 | 0.32 | 145 | 0.07 |
| 11 | " | " | " | 0.64 | 182 | 0.06 |
| 12 | " | " | Compound A | 0.32 | 100 | 0.07 |
| 13 | " | " | " | 0.64 | 98 | 0.07 |
| 14 | I-6 | 2.6 | — | — | 100 | 0.07 |
| 15 | " | 5.2 | — | — | 85 | 0.07 |
| 16 | " | 2.6 | III-10 | 0.68 | 158 | 0.06 |
| 17 | " | 5.2 | " | " | 170 | 0.06 |
| 18 | " | 2.6 | Compound A | 0.68 | 98 | 0.07 |
| 19 | " | 5.2 | " | " | 83 | 0.07 |
| 20 | I-7 | 2.6 | — | — | 100 | 0.07 |
| 21 | " | 5.2 | — | — | 81 | 0.07 |
| 22 | " | 2.6 | III-10 | 0.68 | 135 | 0.06 |
| 23 | " | 5.2 | " | " | 138 | 0.06 |
| 24 | " | 2.6 | Compound A | 0.68 | 100 | 0.07 |
| 25 | " | 5.2 | " | " | 81 | 0.07 |

Nos. 1, 14, 15, 20 and 21: Standard
Nos. 2–11, 16, 17, 22 and 23: Samples of the Invention
Nos. 12, 13, 18, 19, 24 and 25: Comparative Samples

EXAMPLE 2

After adjusting the pH of 2 liters of an aqueous solution containing 70 g of gelatin to 3.0, 2 kg of an aqueous solution containing 1 kg of silver nitrate and 2 kg of an aqueous solution containing 210 g of potassium bromide and 290 g of sodium chloride were simultaneously added to the aqueous gelatin solution at a constant rate over a period of 30 minutes. In this case, the gelatin-containing aqueous solution has contained rhodium in an amount of $5\times10^{-7}$ mol per mol of silver. Then, after removing soluble salts, gelatin was added to the mixture and it was chemically ripened to provide a silver chlorobromide emulsion (grain size 0.31 μm, Br 30 mol %).

To the silver halide emulsion were added the sensitizing dye shown by formula (I) described above and the compound shown by formula (IIIa) or (IIIb) described above as shown in Table 2 below, and after adding 1-hydroxy-3,5-dichlorotriazine sodium salt as a hardening agent and sodium dodecylbenzenesulfonate as a coating aid, the resulting mixture was coated on a polyethylene terephthalate film in a silver amount of 3.9 g/m$^2$ of the film.

The film sample thus prepared was wedge-exposed through a dark red filter (SC-72, made by Fuji Photo Film Co., Ltd.), developed using a developer having the following composition for 3 minutes at 20° C., stopped, fixed, and washed with water. Composition of the developer:

| Composition of the developer: | |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metahydrogensulfite | 1.5 g |
| Water to make | 1 liter |

Then, the sensitivity of the sample thus processed was measured using a P-type sensitometer made by Fuji Photo Film Co., Ltd., to determine sensitivity and fog, using [fog+0.3] as the standard optical density for determining the sensitivity. The results obtained are shown in Table 2.

Also, some of the film samples thus prepared were stored for 3 days under high-temperature and high-humidity conditions (40° C., 75% RH), while other samples were stored . for 3 days at 5° C. and 10% RH for comparison. These samples were exposed, developed, stopped, fixed, washed and dried as above and then the sensitivity was measured by the same manner. The results obtained are shown in Table 3 below.

Compound A used as the comparison compound was 4-hydroxy-6-methyl-1,3,3a,7-tetraazaindene.

TABLE 2

| No. | Sensitizing Dye of Formula (I) Kind | Amount ($\times 10^{-5}$ mol/mol Ag) | Compound of Formula (IIIa) or (IIIb) Kind | Amount (g/mol Ag) | Sensitivity | Fog |
|---|---|---|---|---|---|---|
| 26 | I-11 | 5.2 | — | — | 100 | 0.05 |
| 27 | " | " | III-2 | 0.26 | 148 | 0.05 |
| 28 | " | " | " | 0.52 | 155 | 0.05 |
| 29 | " | " | Compound A | 0.52 | 98 | 0.05 |
| 30 | " | " | III-2 | 0.52 | 151 | 0.05 |
| | | | Compound A | 0.52 | | |
| 31 | I-19 | 5.2 | — | — | 100 | 0.05 |
| 32 | " | " | III-2 | 0.26 | 138 | 0.05 |
| 33 | " | " | " | 0.52 | 151 | 0.05 |
| 34 | " | " | Compound A | 0.52 | 100 | 0.05 |
| 35 | " | " | III-2 | 0.52 | | |
| | | | Compound A | 0.52 | | |
| | | | | | 151 | 0.05 |

Nos. 26 and 31: Standard
Nos. 27, 28, 30, 32, 33, and 35: Samples of the Invention
Nos. 29 and 34: Comparative Samples

TABLE 3

| No. | Sensitizing Dye of Formula (I) Kind | Amount ($\times 10^{-5}$ mol/mol Ag) | Compound of Formula (IIIa) or (IIIb) Kind | Amount (g/mol Ag) | Stored for 3 days at 40° C., 75% RH Sensitivity | Fog | Stored for 3 days at 5° C., 10% RH Sensitivity | Fog |
|---|---|---|---|---|---|---|---|---|
| 36 | I-11 | 5.2 | — | — | at most 10 | 0.07 | 100 (Standard) | 0.05 |
| 37 | " | " | III-2 | 0.26 | 117 | 0.06 | 148 | 0.05 |
| 38 | " | " | " | 0.52 | 138 | 0.05 | 155 | 0.05 |
| 39 | " | " | Compound A | 0.52 | 12 | 0.06 | 98 | 0.05 |
| 40 | " | " | III-2 | 0.52 | 135 | 0.05 | 151 | 0.05 |
| | | | Compound A | 0.52 | | | | |
| 41 | I-19 | 5.2 | — | — | at most 10 | 0.07 | 100 (Standard) | 0.05 |
| 42 | " | " | III-2 | 0.26 | 105 | 0.06 | 138 | 0.05 |
| 43 | " | " | " | 0.52 | 135 | 0.05 | 151 | 0.05 |
| 44 | " | " | Compound A | 0.52 | 13 | 0.06 | 100 | 0.05 |
| 45 | " | " | III-2 | 0.52 | 132 | 0.05 | 151 | 0.05 |
| | | | Compound A | 0.52 | | | | |

Nos. 36 and 41: Standard
Nos. 37, 38, 40, 42, 43, and 45: Samples of the Invention
Nos. 39 and 44: Comparative Samples From the results shown in Table 2, it can be seen that the combination of this invention provides a light-sensitive material having high sensitivity and low fog as compared with the comparison examples using the dye alone. Also, from the results shown in Table 3, it can be seen that the combination of this invention gives not only high sensitivity but also reduces sensitivity loss and increase of fog when storing the light-sensitive material containing the combination under high-temperature and high humidity conditions.

EXAMPLE 3

A silver iodobromide emulsion (iodide content 1.2 mol %) was prepared by precipitating the silver halide grains by a double jet method, physically ripening, desalting, and further chemically ripening the silver halide grains. The mean diameter of the silver halide grains in the emulsion was 0.4 micron and the content of the silver halide was 0.6 mol per kg of the emulsion.

After heating 1 kg of emulsion to 40° C., the sensitizing dye represented by formula (I) described above, and a methanol solution containing the compound represented by formula (IIIa) or (IIIb) described above or Comparison Compound A were added to the emulsion in a definite amount as shown in Table 4 described below, followed by stirring. Then, 35 ml of an aqueous solution containing 1.0% by weight of 1-hydroxy-3,5-dichlorotriazine sodium salt was added to the mixture, and further 50 ml of a 1.0 wt % aqueous solution of sodium dodecylbenzenesalfonate was added thereto followed by stirring.

The silver halide emulsion obtained was coated on a cellulose triacetate film base at a dry thickness of 5 microns and dried to provide a light-sensitive material. The film sample obtained was wedge-exposed using a sensitometer having a light source with a color temperature of 2854° K. equipped with a dark red filter (SC-72) made by Fuji Photo Film Co., Ltd.

After light exposure, the film sample was developed using the developer having the composition shown below for 3 minutes at 20° C., stopped, fixed, and further washed to provide a strip having desired black and white images. Then, the density of the strip was measured using a P-type densitometer made by Fuji Photo Film Co., Ltd. to determine sensitivity and fog, using [fog+0.3] as the standard optical density for determining sensitivity Composition of the developer:

| | |
|---|---|
| Water | 500 ml |
| N-Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |
| Water to make | 1 liter |

The results obtained are shown in Table 4 below as this invention provided a light-sensitive material having markedly higher sensitivity without increasing fog as compared with the comparison examples.

Compound A used as the comparison compound was 4-hydroxy-6-methyl-1,3,3a-7-tetraazaindene.

TABLE 4

| | Sensitizing Dye of Formula (II) | | Compound of Formula (IIIa) or (IIIb) | | | |
|---|---|---|---|---|---|---|
| No. | Kind | Amount ($\times 10^{-5}$ mol/mol Ag) | Kind | Amount (g/mol Ag) | Sensitivity | Fog |
| 46 | II-2 | 4.5 | — | — | 100 | 0.07 |
| 47 | " | " | III-1 | 0.30 | 138 | 0.07 |
| 48 | " | " | " | 0.60 | 151 | 0.06 |
| 49 | " | " | III-6 | 0.30 | 141 | 0.07 |
| 50 | " | " | " | 0.60 | 155 | 0.06 |
| 51 | " | " | III-12 | 0.30 | 145 | 0.07 |
| 52 | " | " | " | 0.60 | 155 | 0.06 |
| 53 | " | " | III-25 | 0.30 | 141 | 0.07 |
| 54 | " | " | " | 0.60 | 162 | 0.06 |
| 55 | " | " | III-33 | 0.30 | 135 | 0.07 |
| 56 | " | " | " | 0.60 | 158 | 0.06 |
| 57 | " | " | Compound A | 0.30 | 100 | 0.07 |
| 58 | " | " | " | 0.60 | 98 | 0.07 |
| 59 | II-3 | 2.5 | — | — | 100 | 0.07 |
| 60 | " | 5.0 | — | — | 79 | 0.07 |
| 61 | " | 2.5 | III-10 | 0.60 | 162 | 0.06 |
| 62 | " | 5.0 | " | " | 170 | 0.06 |
| 63 | " | 2.5 | Compound A | 0.60 | 100 | 0.07 |
| 64 | " | 5.0 | " | " | 78 | 0.07 |
| 65 | II-16 | 2.5 | — | — | 100 | 0.07 |
| 66 | " | 5.0 | — | — | 76 | 0.07 |
| 67 | " | 2.5 | III-10 | 0.60 | 151 | 0.06 |
| 68 | " | 5.0 | " | 0.60 | 158 | 0.06 |
| 69 | " | 2.5 | Compound A | 0.60 | 100 | 0.07 |
| 70 | " | 5.0 | " | 0.60 | 74 | 0.07 |

Nos. 46, 59, 60, 65, and 66: Standard
Nos. 47–56, 61, 62, 67, and 68: Samples of the Invention
Nos. 57, 58, 63, 64, 69, and 70: Comparative Samples

EXAMPLE 4

After adjusting the pH of 2 liters of an aqueous solution containing 70 g of gelatin to 3.0, 2 kg of an aqueous solution containing 1 kg of silver nitrate and 2 kg of an aqueous solution containing 210 g of potassium bromide and 290 g of sodium chloride were simultaneously added to the aqueous gelatin solution at a constant rate over a period of 30 minutes. In this case, the gelatin-containing aqueous solution has contained rhodium in an amount of $5\times10^{-7}$ mol per mol of silver. Then, after removing soluble salts, gelatin was added to the mixture and it was chemically ripened to provide a silver chlorobromide emulsion (grain size: 0.31 μm, Br 30 mol %). To the emulsion was added 4-hydroxy-6-methyl-1,3,3a,7-tetraazaindene as a stabilizer.

To the silver halide emulsion were added the sensitizing dye shown by formula (II) described above and the compound shown by formula (IIIa) or (IIIb) described above as shown in Table 5 below, and after further adding 1-hydroxy-3,5-dichlorotriazine sodium salt as a hardening agent and sodium dodecylbenzenesulfonate as a coating aid, the resultant mixture was coated on a polyethylene terephthalate film in a silver amount of 4.2 g/m$^2$ of the film.

The film sample thus prepared was wedge-exposed through a dark red filter (SC-72, made by Fuji Photo Film Co., Ltd.), developed using the developer having the composition shown below for 3 minutes at 20° C., stopped, fixed, and washed.

| Composition of the developer: | |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metahydrogensulfite | 1.5 g |
| Water to make | 1 liter |

Then, the sensitivity of the sample thus prepared was measured using a P-type sensitometer made by Fuji Photo Film Co., Ltd., to provide sensitivity and fog, using [fog+0.3] as the standard optical density for determining sensitivity. The results obtained are shown in Table 5 below.

In addition, some of the film samples thus prepared were stored for 3 days under high-temperature and high-humidity conditions (40° C., 75% RH), while other samples were stored for 3 days at 5° C. and 10% RH for comparison. These samples were exposed, developed, stopped, fixed, washed and dried as above, and then the sensitivity was measured in the same manner as above. The results obtained are shown in Table 6 below.

Compound A used as the comparison compound was 4-hydroxy-6-methyl-1,3,3a,7-tetraazaindene.

TABLE 5

| | Sensitizing Dye of Formula (II) | | Compound of Formula (IIIa) or (IIIb) | | | |
|---|---|---|---|---|---|---|
| No. | Kind | Amount ($\times 10^{-5}$ mol/mol Ag) | Kind | Amount (g/mol Ag) | Sensitivity | Fog |
| 71 | II-6 | 5.0 | — | — | 100 | 0.05 |

TABLE 5-continued

| No. | Sensitizing Dye of Formula (II) Kind | Amount ($\times 10^{-5}$ mol/mol Ag) | Compound of Formula (IIIa) or (IIIb) Kind | Amount (g/mol Ag) | Sensitivity | Fog |
|---|---|---|---|---|---|---|
| 72 | " | " | III-2 | 0.26 | 158 | 0.05 |
| 73 | " | " | " | 0.52 | 174 | 0.05 |
| 74 | " | " | Compound A | 0.52 | 98 | 0.05 |
| 75 | " | " | III-2 | 0.52 | 170 | 0.05 |
| | | | Compound A | 0.52 | | |
| 76 | II-7 | 5.0 | — | — | 100 | 0.05 |
| 77 | " | " | III-2 | 0.26 | 166 | 0.05 |
| 78 | " | " | " | 0.52 | 186 | 0.05 |
| 79 | " | " | Compound A | 0.52 | 100 | 0.05 |
| 80 | " | " | III-2 | 0.52 | 182 | 0.05 |
| | | | Compound A | 0.52 | | |

Nos. 71 and 76: Standard
Nos. 72, 73, 75, 77, 78, and 80: Samples of the Invention
Nos. 74 and 79: Comparative Samples

TABLE 6

| No. | Sensitizing Dye of Formula (I) Kind | Amount ($\times 10^{-5}$ mol/mol Ag) | Compound of Formula (IIIa) or (IIIb) Kind | Amount (g/mol Ag) | Stored for 3 days at 40° C., 75% RH Sensitivity | Fog | Stored for 3 days at 5° C., 10% RH Sensitivity | Fog |
|---|---|---|---|---|---|---|---|---|
| 81 | II-6 | 5.0 | — | — | at most 10 | 0.07 | 100 | 0.05 |
| 82 | " | " | III-2 | 0.26 | 123 | 0.06 | 158 | 0.05 |
| 83 | " | " | " | 0.52 | 151 | 0.05 | 174 | 0.05 |
| 84 | " | " | Compound A | 0.52 | 11 | 0.06 | 96 | 0.05 |
| 85 | " | " | III-2 | 0.52 | 151 | 0.05 | 170 | 0.05 |
| | | | Compound A | 0.52 | | | | |
| 86 | II-7 | 5.0 | — | — | at most 10 | 0.07 | 100 | 0.05 |
| 87 | " | " | III-2 | 0.26 | 135 | 0.06 | 166 | 0.05 |
| 88 | " | " | " | 0.52 | 166 | 0.05 | 186 | 0.05 |
| 89 | " | " | Compound A | 0.52 | 12 | 0.06 | 98 | 0.05 |
| 90 | " | " | III-2 | 0.52 | 166 | 0.05 | 182 | 0.05 |
| | | | Compound A | 0.52 | | | | |

Nos. 81 and 86: Standard
Nos. 82, 83, 85, 87, 88, and 90: Samples of the Invention
Nos. 84 and 89: Comparative Samples From the results shown in Table 5, it can be seen that the combination of this invention provided an excellent light-sensitive material having surprisingly high sensitivity without increasing fog, as compared with the comparison examples. Also, from the results shown in Table 6, it can be seen that the combination of this invention provided high sensitivity as well as improved retention of sensitivity and reduced of fog, when storing the light-sensitive material under high-temperature and high-humidity conditions.

As described above, according to this invention, silver halide emulsions having both high sensitivity for infrared light and minimal fog are obtained. Also, the silver halide photographic, materials using the silver halide photographic emulsions of this invention have excellent storage stability, i.e., better sensitivity and limited fog under high-temperature and high-humidity conditions.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising a silver halide, at least one infrared sensitizing dye represented by the following general formula (I) or (II), and at least one supersensitizing compound represented by the following general formula (IIIa) or (IIIb): 0

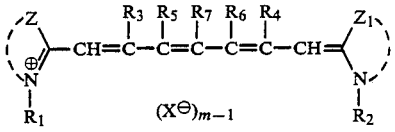

(I)

wherein, $R_1$ and $R_2$, which may be the same or different, each represents an alkyl group or a substituted alkyl group; $R_3$ and $R_4$, which may be the same or different, each represents a hydrogen atom, a lower alkyl group, a lower alkoxy group, a phenyl group, or a benzyl group; $R_5$ and $R_6$ both represent a hydrogen atom or are bonded to form a divalent alkylene group; $R_7$ represents a hydrogen atom, a lower alkyl group, a lower alkoxy group, a phenyl group, a benzyl group, or

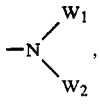

wherein, $W_1$ and $W_2$, which may be the same or different, each represents a substituted or unsubstituted alkyl group or a substituted or unsubstituted aryl group, provided that said $W_1$ and $W_2$ may be bonded to form a 5-membered or 6-membered nitrogen-containing heterocyclic ring; or said $R_3$ and $R_7$ may be bonded to form a divalent alkylene group; Z and $Z_1$, which may be the same or different, each represents a non-metallic atomic group necessary for forming a 5-membered or 6-membered nitrogen-containing heterocyclic ring; $X^{\ominus}$ represents an acid anion; and m represents 1 or 2;

(II)

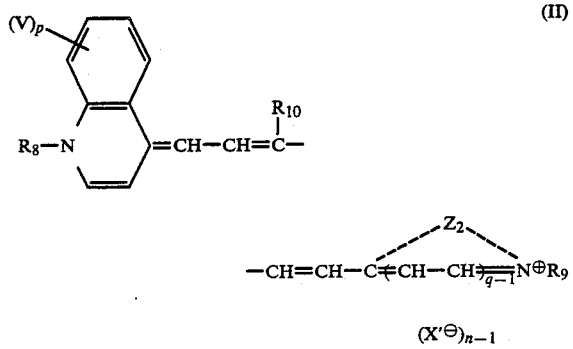

wherein, $R_8$ and $R_9$, which may be the same or different, each represents an alkyl group or a substituted alkyl group; $R_{10}$ represents a hydrogen atom, a lower alkyl group, a lower alkoxy group, a phenyl group, or a benzyl group; V represents a hydrogen atom, a lower alkyl group, an alkoxy group, a halogen atom, or a substituted alkyl group; $Z_2$ represents a non-metallic atomic group necessary for forming a 5-membered or 6-membered nitrogen-containing heterocyclic ring; $X'^{\ominus}$ represents an acid anion; and n, p, and q, which may be the same or different, each represents 1 or 2;

(IIIa)

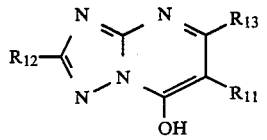

(IIIb)

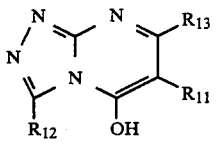

wherein, $R_{11}$ and $R_{12}$ each represents a hydrogen atom, a lower alkyl group, an alkenyl group, a carboxy group, an alkoxy group, or a halogen atom; and $R_{13}$ represents an alkyl group having at least 5 carbon atoms, an aralkyl group, an aryl group, an alkylthio group, an arylthio group, an alkoxy group having at least 3 carbon atoms, an aryloxy group, an alkylamino group having at least 3 carbon atoms, an arylamino group,

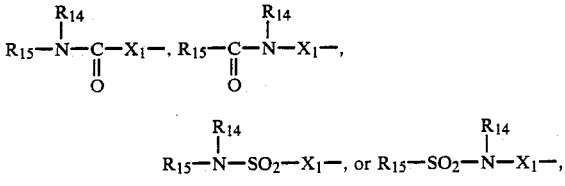

wherein, $X_1$ represents a divalent linkage group, and $R_{14}$ and $R_{15}$, which may be the same or different, each represents a hydrogen atom, an alkyl group, an alkenyl group, an aralkyl group, an aryl group, or a heterocyclic group.

2. The silver halide photographic emulsion as claimed in claim 1, wherein $R_1$, $R_2$, $R_8$ and $R_9$ each is selected from the group consisting of an unsubstituted alkyl group having from 1 to 8 carbon atoms and a substituted alkyl group having from 1 to 6 carbon atoms that is substituted with a carboxy group, a sulfo group, a cyano group, a halogen atom, a hydroxy group, an alkoxycarbonyl group, an alkoxy group, an aryloxy group, an acyloxy group, an acyl group, a carbamoyl group, a sulfamoyl group, or an aryl group; $R_3$, $R_4$ and $R_{10}$ each is selected from the group consisting of a hydrogen atom, an alkyl group having from 1 to 6 carbon atoms, an alkoxy group having from 1 to 6 carbon atoms, a phenyl group and a benzyl group; when $R_5$ and $R_6$ combine to form an alkylene group, said alkylene group is an ethylene group or a trimethylene group, each of which is unsubstituted or substituted with an alkyl group having from 1 to 4 carbon atoms, a halogen atom, or an alkoxy group having from 1 to 4 carbon atoms; $R_7$ is selected from the group consisting of a hydrogen atom, an alkyl group having from 1 to 8 carbon atoms, an alkoxy group having from 1 to 8 carbon atoms, a phenyl group, a benzyl group, and

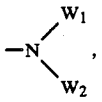

wherein $W_1$ and $W_2$ each represents a substituted or unsubstituted alkyl group having 1 to 4 carbon atoms, or a substituted or unsubstituted aryl group; each of said heterocyclic rings formed by Z, $Z_1$ and $Z_2$ is selected from the group consisting of a thiazole nucleus, a selenazole nucleus, an oxazole nucleus, a quinoline nucleus, a 3,3-dialkylindolenine nucleus, an imidazole nucleus, and a pyridine nucleus; V is selected from the group consisting of a hydrogen atom, a substituted or unsubstituted alkyl group having from 1 to 8 carbon atoms, an alkoxy group having from 1 to 8 carbon atoms, and a halogen atom, $R_{11}$ and $R_{12}$ each is selected from the group consisting of a hydrogen atom, a substituted or unsubstituted alkyl group having from 1 to 4 carbon atoms, a substituted or unsubstituted alkenyl group having from 2 to 4 carbon atoms, a carboxy group, a substituted or unsubstituted alkoxy group having from 1 to 5 carbon atoms, and a halogen atom; $R_{13}$ is selected from the group consisting of an alkyl group having at least 5 carbon atoms, a substituted or unsubstituted aralkyl group having from 7 to 12 carbon atoms, a substituted or unsubstituted aryl group having from 6 to 12 carbon atoms, a substituted or unsubstituted alkylthio group having from 1 to 10 carbon atoms, a substituted or unsubstituted arylthio group having from 6 to 12 carbon atoms, an alkoxy group having at least 3 carbon atoms, an aryloxy group, an alkylamino group having at least 3 carbon atoms, an arylamino group,

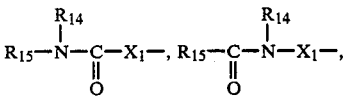

-continued $$R_{15}-\overset{R_{14}}{\overset{|}{N}}-SO_2-X_1-, \text{ or } R_{15}-SO_2-\overset{R_{14}}{\overset{|}{N}}-X_1-$$

wherein $X_1$ is an alkylene group having from 1 to 5 carbon atoms, and $R_{14}$ and $R_{15}$ each is selected from the group consisting of a hydrogen atom, a substituted or unsubstituted alkyl group having from 1 to 10 carbon atoms, a substituted or unsubstituted alkenyl group having from 2 to 10 carbon atoms, a substituted or unsubstituted aralkyl group having from 7 to 12 carbon atoms, a substituted or unsubstituted aryl group having from 6 to 12 carbon atoms, and a heterocyclic group.

3. The silver halide photographic emulsion as claimed in claim 2, wherein each of said heterocyclic rings formed by Z, $Z_1$ and $Z_2$ is selected from the group consisting of a benzothiazole nucleus, a naphthothiazole nucleus, a naphthoxazole nucleus, and a benzoxazole nucleus $R_{10}$ is an alkyl group having from 1 to 6 carbon atoms or a benzyl group.

4. The silver halide photographic emulsion as claimed in claim 1, wherein said infrared sensitizing dye represented by general formula (I) or (II) is present in an amount of from $5\times10^{-7}$ mol to about $5\times10^{-3}$ mol per mol of said silver halide, and the weight ratio of said infrared sensitizing dye to said compound represented by general formula (IIIa) or (IIIb) is from about 1/1 to 1/300.

5. The silver halide photographic emulsion as claimed in claim 4, wherein said infrared sensitizing dye represented by general formula (I) or (II) is present in an amount of from about $1\times10^{-6}$ mol to about $1\times10^{-3}$ mol per mol of said silver halide, and the weight ratio of said infrared sensitizing dye to said compound represented by general formula (IIIa) or (IIIb) is from about 1/1 to 1/300.

6. The silver halide photographic emulsion as claimed in claim 4, wherein said infrared sensitizing dye represented by general formula (I) or (II) is present in an amount of from about $2\times10^{-6}$ mol to about $5\times10^{-4}$ mol per mol of said silver halide, and the weight ratio of said infrared sensitizing dye to said compound represented by general formula (IIIa) or (IIIb) is from about $\frac{1}{2}$ to 1/100.

7. The silver halide photographic emulsion as claimed in claim 1, wherein said silver halide is silver chlorobromide or silver chloroiodobromide containing not more than about 1 mol per cent silver iodide.

8. The silver halide photographic emulsion as claimed in claim 7, wherein said silver halide emulsion is a monodispersed emulsion comprising silver halide grains having a mean diameter of not more than about 0.7 micron.

* * * * *